US011118837B1

(12) United States Patent
Barsky

(10) Patent No.: US 11,118,837 B1
(45) Date of Patent: Sep. 14, 2021

(54) VACUUM OVEN WITH TWO SIDED DOOR SYSTEM

(71) Applicant: Alexander Edward Joseph Barsky, Naples, FL (US)

(72) Inventor: Alexander Edward Joseph Barsky, Naples, FL (US)

( * ) Notice: Subject to any disclaimer, the term of this patent is extended or adjusted under 35 U.S.C. 154(b) by 0 days.

(21) Appl. No.: 16/811,253

(22) Filed: Mar. 6, 2020

Related U.S. Application Data

(60) Provisional application No. 62/863,190, filed on Jun. 18, 2019.

(51) Int. Cl.

| | |
|---|---|
| ***F27B 14/04*** | (2006.01) |
| ***F27B 5/18*** | (2006.01) |
| ***F27B 5/04*** | (2006.01) |
| ***F27D 11/00*** | (2006.01) |
| ***F27D 15/00*** | (2006.01) |
| *F27D 19/00* | (2006.01) |

(52) U.S. Cl.
CPC ..... *F27B 5/18* (2013.01); *F27B 5/04* (2013.01); *F27D 11/00* (2013.01); *F27D 15/00* (2013.01); *F27B 2014/045* (2013.01); *F27D 2019/0006* (2013.01); *F27D 2019/0009* (2013.01); *F27D 2019/0018* (2013.01); *F27M 2003/15* (2013.01)

(58) Field of Classification Search
CPC .. F27D 15/00; F27D 11/00; F27D 2019/0018; F27D 2019/0006; F27D 2019/0009; F27B 5/18; F27B 2014/045; F27B 14/04
See application file for complete search history.

(56) References Cited

U.S. PATENT DOCUMENTS

2007/0231485 A1* 10/2007 Moffat ..... B05D 7/24 427/248.1
2007/0287118 A1* 12/2007 Smith ..... F27B 5/06 432/205

* cited by examiner

*Primary Examiner* — Gregory A Wilson
(74) *Attorney, Agent, or Firm* — Michael D. Eisenberg

(57) ABSTRACT

A system for treatment of a first material with at least one hazardous material, the system comprising a manufacturing room configured according to safety standards to hold at least one hazardous material. The manufacturing room is configured for the treatment of the first material using the at least one hazardous material as a solvent. A holding room is not configured according to the safety standards and is separated from the manufacturing room by a wall common to the manufacturing room and the holding room. A vacuum oven is embedded in the wall, and has a rear portion in the manufacturing room and a front portion in the holding room. The front door of the oven is configured to be opened from the holding room for removing the first material from the inner cavity following removal of the at least one hazardous material from the first material and from the inner cavity and no electrical components of the vacuum oven extend into the manufacturing room.

18 Claims, 15 Drawing Sheets

VACUUM OVEN WITH TWO SIDED DOOR SYSTEM

CROSS-REFERENCES TO RELATED APPLICATIONS

The present application claims priority from U.S. Provisional Application Ser. No. 62/863,190 filed on Jun. 18, 2019, which is hereby incorporated herein by reference in its entirety.

TECHNICAL FIELD

The present application, in some embodiments thereof, relates to the transportation of material which have been treated with hazardous material out of designated hazardous environments.

BACKGROUND

Extracting plant material with certain hazardous solvents is often required to take place within an electrically classified location (for example, locations that are classified as C1D1/C1D2 under the National Electrical Code, as known as NFPA 70), as the solvents produce flammable vapors at ignitable concentrations. After the extraction is complete, some safety protocols require that the extracted product reaches below 25% or 15% the lower explosive limit (LEL) of the flammable vapor before it leaves the electrically classified location and enters a vacuum oven. Extraction companies have difficulty maintaining quality of product when applying this standard operating procedure to their extraction systems and procedures.

The present invention addresses the issue raised by the above problem.

BRIEF SUMMARY OF THE INVENTION

Therefore, an aspect of some embodiments of the present invention relates to a system for treatment of a first material with at least one hazardous material, the system comprising a manufacturing room configured according to first safety standards to hold at least one hazardous material. The manufacturing room is configured for the treatment of the first material using the at least one hazardous material as a solvent. A holding room is provided and is not configured according to the first safety standard as the holding room is separated from the manufacturing room by a wall common to the manufacturing room and the holding room. A vacuum oven is embedded in the wall and has a rear portion in the manufacturing room and a front portion in the holding room. The vacuum oven comprises: an inner cavity configured for holding the first material treated with the at least one hazardous material, the inner cavity being surrounded by a housing; an electrically powered heating element configured to heat the inner cavity, with the heating element joined to an outer surface of the housing and located in the front portion of the vacuum oven; a front door covering a front side of the inner cavity and is located in the manufacturing room; a back door covering a rear side of the inner cavity opposite the first side and is located in the holding room; and an electrical apparatus located in the holding room. The electrical apparatus comprises an electrically powered control panel configured to receive from a user in the holding room a first input to operate the heating element and to operate the heating element according to the first input. An electrically powered vacuum pump is located in the holding room and is in fluid communication with the inner cavity of the vacuum oven. The vacuum pump is configured to lower a pressure within the inner cavity. The control panel is configured to control an operation of the vacuum pump and comprises a first valve configured to control air flow from the inner cavity to the vacuum pump and a second valve configure to control air flow from an external environment into the inner cavity. The vacuum oven is configured to receive the first material treated with the at least one hazardous material from the manufacturing room via the back door. When both the front door and the back door are closed, the heating element is configured to be controlled by the user via the control panel to raise a temperature of the inner cavity. The vacuum pump is configured to be controlled by the user via the control panel to lower the pressure within the inner cavity. The first valve is configured to be opened to allow air flow from the inner cavity to the vacuum pump, and the second valve is closed to prevent air flow from the external environment to the inner cavity, such that to the pressure within the inner cavity is lower than a vapor pressure of the hazardous material at the temperature of the inner cavity, thereby vaporizing the hazardous material. The vacuum pump is further configured to lead a vapor of the hazardous material out of the inner cavity, thereby removing at least some of the the hazardous material from the first material and from the inner cavity and reducing a concentration of the vapor of the hazardous material below a predetermined ignitable concentration. The front door is configured to be opened from holding room for removing the first material from the inner cavity following removal of the at least one hazardous material from the first material and from the inner cavity. No electrical components of the vacuum oven extend into the manufacturing room.

In a variant, the vacuum oven comprises an interlock configured for preventing an opening of the front door and the back door during the operation of the heating element and of the vacuum pump.

In another variant, the vacuum oven comprises a gas sensor configured for measuring a quantity of the vapor of the hazardous material in the air flow leaving the inner cavity due to the operation of the vacuum pump and to generate gas data indicative of the measured quantity. An interlock is configured to lock the front door and a control unit is configured to receive the gas data and connected to the interlock, the control unit being configured to release the interlock, thereby unlocking the front door, when the measured quantity is below a predetermined threshold level.

In a further variant, the electrical apparatus further comprises at least one electrically powered data outlet configured for being connected to at least one external device, the data outlet being located in the holding room.

In still another variant, a temperature sensor is configured to measure the temperature in the inner cavity and to generate temperature data indicative of the temperature in the inner cavity, the temperature sensor having a sensing end located within the inner cavity in the holding room and a data generating end located outside the inner cavity. A temperature display is located in the holding room on the control panel and configured to receive the temperature data and to display an image indicative of the temperature measured by the temperature sensor. Wiring leads from the data generating end of the temperature sensor to the temperature display, and is located outside the inner cavity. The temperature sensor is joined to the housing of the inner cavity via an opening on the housing, such that the sensing end extends inside the inner cavity and the data generating end is located outside the inner cavity, and the opening is hermetically closed by the temperature sensor such that air flow via the opening is prevented.

In yet a further variant, a pressure sensor is configured to measure pressure in the inner cavity and located in the holding room and a pressure display is configured to display data indicative of the pressure measured by the pressure sensor and located in the holding room.

In a variant, the electrical apparatus further comprises at least one electrically powered data outlet configured for being connected to at least one external device, the data outlet located in the holding room. The data generating end of the temperature sensor is connected to the at least one data outlet and configured for transmitting the temperature data to the data outlet.

In another variant, the electrical apparatus further comprises at least one electrically powered data outlet configured for being connected to at least one external device, and the data outlet is located in the holding room. The pressure sensor is configured to generate pressure data indicative of the pressure measured by the pressure sensor. The pressure sensor is connected to the at least on data outlet and is configured to transmit to the data outlet the pressure data.

In yet another variant, the inner cavity is configured according to the first safety standards to hold the hazardous material in liquid form and according to second safety standards to hold the vapor of the hazardous material at an ignitable concentration, when the front door and the back door are closed.

Another aspect of some embodiments of the present invention relates to a vacuum oven system is configured to dry a first material treated with at least one hazardous material, and has a rear portion and a front portion, with the rear portion extending horizontally from a rear face of the vacuum oven to an intermediate location and the front portion extends horizontally from the intermediate position to a front face of the vacuum oven. The vacuum oven comprises: an inner cavity configured for holding the first material treated with the at least one hazardous material; an electrically powered heating element configured to heat the inner cavity, the heating element is joined to an outer surface of the housing and is located in the front portion of the vacuum oven; piping in fluid communication with the inner cavity and configured to lead from the inner cavity to an electrically powered vacuum pump configured to lower pressure within the inner cavity; a front door covering the front face vacuum oven; a back door covering the rear face of the vacuum oven; an electrical apparatus located in the front portion, the electrical apparatus is electrically connected to the heating element and configured to be electrically connected to the vacuum pump. The electrical apparatus comprises an electrically powered control panel configured to receive from a user an input to operate the heating element and the vacuum pump and configured to operate the heating element and the vacuum pump according to the input. The control panel is configured to control an operation of the vacuum pump and comprises a first valve configured to controlling air flow through the piping from the inner cavity to the vacuum pump and a second valve configure to control air flow from an external environment into the inner cavity. The vacuum oven is configured to be embedded in a wall separating a manufacturing room configured according to safety standards to hold the at least one hazardous material and a holding room, wherein the front portion is configured to fully extend into the holding room and the rear portion at least partially extends into the manufacturing room. The vacuum oven is configured to receive the first material treated with the at least one hazardous material from the manufacturing room via the back door. When both the front door and the back door are closed, the heating element is configured to be controlled by the user via the control panel to raise a temperature of the inner cavity. The vacuum pump is configured to be controlled by the user via the control panel to lower the pressure within the inner cavity. The first valve is configured to be opened to allow air flow from the inner cavity to the vacuum pump, and the second valve is closed to prevent air flow from the external environment to the inner cavity, such that to the pressure within the inner cavity is lower than a vapor pressure of the hazardous material at the temperature of the inner cavity, thereby vaporizing the hazardous material. The vacuum pump is further configured to lead a vapor of the hazardous material out of the inner cavity, thereby removing at least some of the hazardous material from the first material and from the inner cavity and reducing a concentration of the vapor of the hazardous material below a predetermined ignitable concentration. The front door is configured to be opened from the holding room for removing the first material from the inner cavity following removal of the at least one hazardous material from the first material and no electrical components of the vacuum oven extend to the rear portion.

In a variant of the vacuum oven system, an interlock is configured for preventing an opening of the front door and the back door during the operation of the heating element and of the vacuum pump.

In yet a further variant, a gas sensor configured for measuring a quantity of the vapor of the hazardous material in the air flowing through the piping from the inner cavity and to generate gas data indicative of the measured quantity. An interlock is configured to lock the front door and a control unit is configured to receive the gas data and connected to the interlock, the control unit being configured to release the interlock, thereby unlocking the front door, when the measured quantity is below a predetermined threshold level.

In a variant of the vacuum oven system, the electrical apparatus further comprises at least one electrically powered data outlet configured for being connected to at least one external device, the data outlet being located in the holding room.

In another variant, a temperature sensor is configured to measure the temperature in the inner cavity and to generate temperature data indicative of the temperature in the inner cavity, the temperature sensor having a sensing end located within the inner cavity in the front portion and a data generating end located outside the inner cavity. A temperature display is located on the control panel and configured to receive the temperature data and to display an image indicative of the temperature measured by the temperature sensor. Wiring is provided and leads from the data generating end of the temperature sensor to the temperature display, the wiring being located outside the inner cavity. The temperature sensor is joined to the housing of the inner cavity via an opening on the housing, such that the sensing end extends inside the inner cavity and the data generating end is located outside the inner cavity, and the opening is hermetically closed by the temperature sensor such that air flow via the opening is prevented.

In a further variant, a pressure sensor is configured to measure pressure in the inner cavity and located in the front portion. A pressure display is configured to display data indicative of the pressure measured by the pressure sensor and located on the control panel.

In still another variant, the electrical apparatus further comprises at least one electrically powered data outlet configured for being connected to at least one external device, the data outlet being located in the front portion. The data generating end of the temperature sensor is connected to the at least one data outlet and configured for transmitting the temperature data to the data outlet.

In yet a further variant, the electrical apparatus further comprises at least one electrically powered data outlet configured for being connected to at least one external device, the data outlet being located in the front portion. The pressure sensor is configured to generate pressure data indicative of the pressure measured by the pressure sensor. The pressure sensor is connected to the at least on data outlet and is configured to transmit to the data outlet the pressure data.

In a variant, the inner cavity is configured according to first safety standards to hold the hazardous material in liquid form and according to second safety standards to hold the vapor of the hazardous material at an ignitable concentration, when the front door and the back door are closed.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
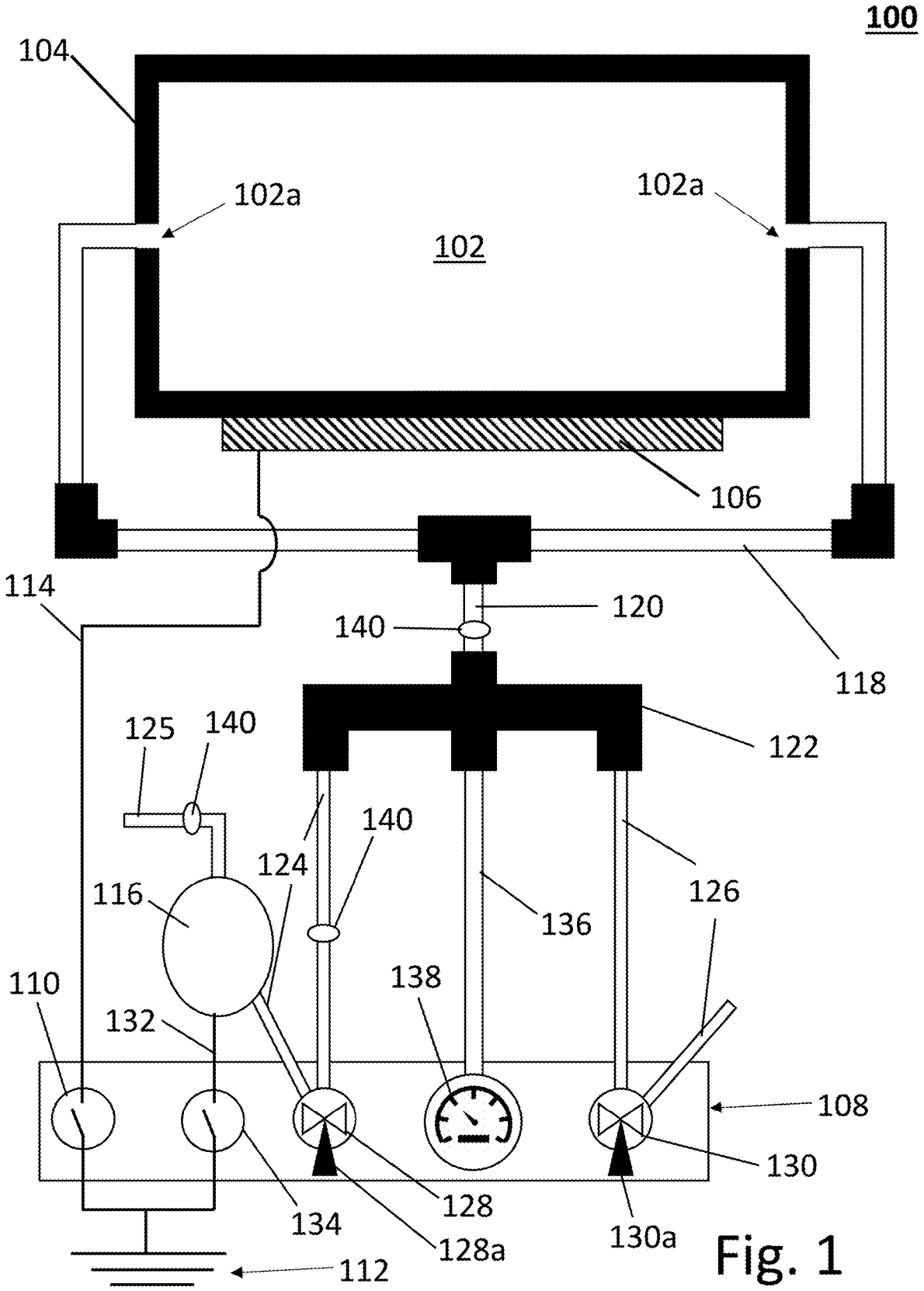
FIG. 1 is a diagram illustrates a vacuum oven with tubes in fluid communication with the inner cavity of the vacuum oven, according to some embodiments of the present invention.

FIG. 1 is a diagram illustrates a vacuum oven 100 with tubes in fluid communication with the inner cavity of the vacuum oven, according to some embodiments of the present invention.

The vacuum oven 100 includes an inner cavity 102 surrounded by heat conducting walls 104, a heating element 106, a user interface 108, and a piping apparatus. Access to the inner cavity 102 is provided by a front door and a back door, as will be explained further below. The vacuum oven 100 is configured for receiving a first material treated with a liquid hazardous material (as defined in the Flammable and Combustible Liquids Code (NFPA 30), in Table 5.2.1.1.3-Maximum Allowable Quantity (MAQ) of Hazardous Materials per Control Area) in the inner cavity 102, and for removing at least some of the hazardous material from the first material by vaporizing the hazardous material and leading the vaporized hazardous material out of the vacuum oven. The vaporized hazardous material is flammable and may be led, for example, to an enclosed location that is configured for safely holding the flammable vapors at ignitable concentration according to safety protocols, for example a C1D1 or C1D2 location under NFPA 70. The inner cavity 102 of the vacuum oven is also an enclosed location configured for safely holding flammable vapors at ignitable concentration (for example a C1D1 or C1D2 location under NFPA 70), as during the vaporization, the flammable vapors may reach ignitable concentration before being led out of the vacuum oven. At least some of the the hazardous material is vaporized by raising the temperature of the inner cavity and lowering the pressure within the inner cavity such that to the pressure within the inner cavity is lower than a vapor pressure of the hazardous material at the temperature of the inner cavity. At least part of the vapor of hazardous material is led out of the inner cavity, so that the concentration of the vapor of the hazardous material is below a predetermined ignitable concentration of the vapor. After the removal of the vaporized hazardous material from the inner cavity, pressure is brought back to atmospheric pressure in the vacuum oven. At this point, the concentration of the flammable vapors in the inner cavity 202 is below ignitable concentration and the quantity of hazardous liquid solvent is below the Maximum Allowable Quantity (MAQ), as defined above. Therefore, the front door of the vacuum oven that leads to a holding room not configured to hold liquid hazardous materials or flammable vapors according to safety standards (for example, NFPA 30 and NFPA 70) can be safely opened, allowing removal of the first material in an environment that is not classified for holding hazardous material or flammable vapors.

The heating element 106 is electrically powered and is controlled via the control panel 108. The heating element 106 may be, for example a resistive heating element, which produces heat as a result of resistance to electrical current passes therethrough. The heating element is joined to the outer surface of the wall 104. The heat generated by the heating element 106 is transferred to the inner cavity 102 via the thermally conductive wall 104 and raises the temperature within the inner cavity. The heating element is disposed outside the inner cavity 102, such that no electrical components are located in the inner cavity. This is because the hazardous material may cause an explosion if the hazardous material is exposed to an electrical spark generated by the heating element 106 and/or by the wire 114 conducting current to the electrical element.

The control panel 108 includes a first switch 110 which controls the passage of electrical current from a power source 112 to the heating element 106 via the electrical wire 114. The first switch 110 is configured for being manipulated by a user to control the operation of the heating element.

The pressure within the inner cavity is regulated by a vacuum pump 116, which may be part of the vacuum oven 100 or may be connectable to the vacuum oven 100. The wall 104 of inner cavity 102 has one or more openings 102*a*. One or more pipes 118 are hermetically joined to the openings 102*a* and are in fluid communication with the inner cavity 102. The pipes 118 to seal the inner cavity 102, and ensure that when the doors of the oven 100 are closed, flow of gases into and out of the inner cavity occurs only via the pipes 118. The pipes 118 are is in fluid communication with a tube 120 which leads to a manifold 122. The manifold 122 connects the tube 120 to a first duct 124 and to a second duct 126. The first duct 124 leads to the vacuum pump 116, while the second duct 126 leads to an outside environment. The flow through first duct 124 is regulated by a first valve 128. The flow through second duct 126 is regulated by a second valve 130. The first valve 128 and the second valve 130 are controlled, respectively, via the first regulator 128*a* and the second regulator 130*a* on the control panel 118 and are used by a user to control the pressure in the inner cavity. The inlet of the vacuum pump 116 receives the first duct 124, while the outlet of the vacuum pump 116 is connected to an exhaust duct 125. The first regulator 128*a* and the second regulator 130*a* may include, for example, handles, lever, knobs, or electrical or mechanical switches.

The vacuum pump 116 is powered by the electrical power source 112 via a second electrical wire 132. A second switch 134 is configured to control the passage of electrical current through the second electrical wire 132. The second switch 134 is included in the control panel 108 and is configured to be manipulated by the user in order to control the operation of the vacuum pump.

In order to lower pressure within the inner cavity 102, the doors of the vacuum oven are closed, the second valve 130 is closed to prevent air from the external environment from entering the inner cavity 102 via the second duct 126, the second switch 134 is turned on to power the vacuum pump 116, and the first valve is opened to enable the vacuum pump to create a flow from the inner cavity to the pipe(s) 118, the tube 120, the first duct 124. The vacuum pump 116 receives the air from the inner cavity via the first duct 124 and exhausts the received air via the exhaust duct 125. In this manner the vaporized hazardous material is removed from the inner cavity 102 and exhausted away.

Once it has been confirmed that the concentration of the vapors in the inner cavity is less than a desired amount (for example, via one or more gas sensors 140 located along the pipe(s) 118, and/or along the first duct 124, and/or along the exhaust duct 125) or that the pressure inside the inner cavity 102 has been lower than a threshold pressure for a certain time, the first valve 128 is closed to prevent air with hazardous vapors from flowing back into the inner cavity 102, the second switch 134 is switched off to stop the flow of electrical power to the vacuum pump 116, and the second valve 130 is opened in order to create an air flow from the external environment to the inner cavity via the second duct 126. When the second valve has been opened, air flows from the external environment into the inner cavity via the second duct 126, the tube 120, the pipe(s) 118, since air pressure in the external environment is higher than the air pressure in the cavity. Once the pressure in the inner cavity 102 has reached a desired value (for example, atmospheric pressure), the front door of the vacuum oven is opened in order to retrieve the first material into an environment that needs not be classified for hazardous materials.

In some embodiments of the present invention, the manifold 122 further connects the tube 120 to a first end of a third duct 136, which has a second end connected to a pressure sensor 138. Because the pressure sensor 138 is in fluid communication with the inner cavity 102, the pressure sensor 138 measures a pressure of within the inner cavity 102. The pressure sensor 138 may be have an analog or digital dial located on the user interface to display a pressure value within the inner cavity 122 to a user. In some embodiments of the present invention, the pressure sensor 138 is configured to generate machine-readable data in response to the detected pressure. As will be seen further below, the pressure data can be transferred to an external device via an electrically powered data outlet.

Figure 2:
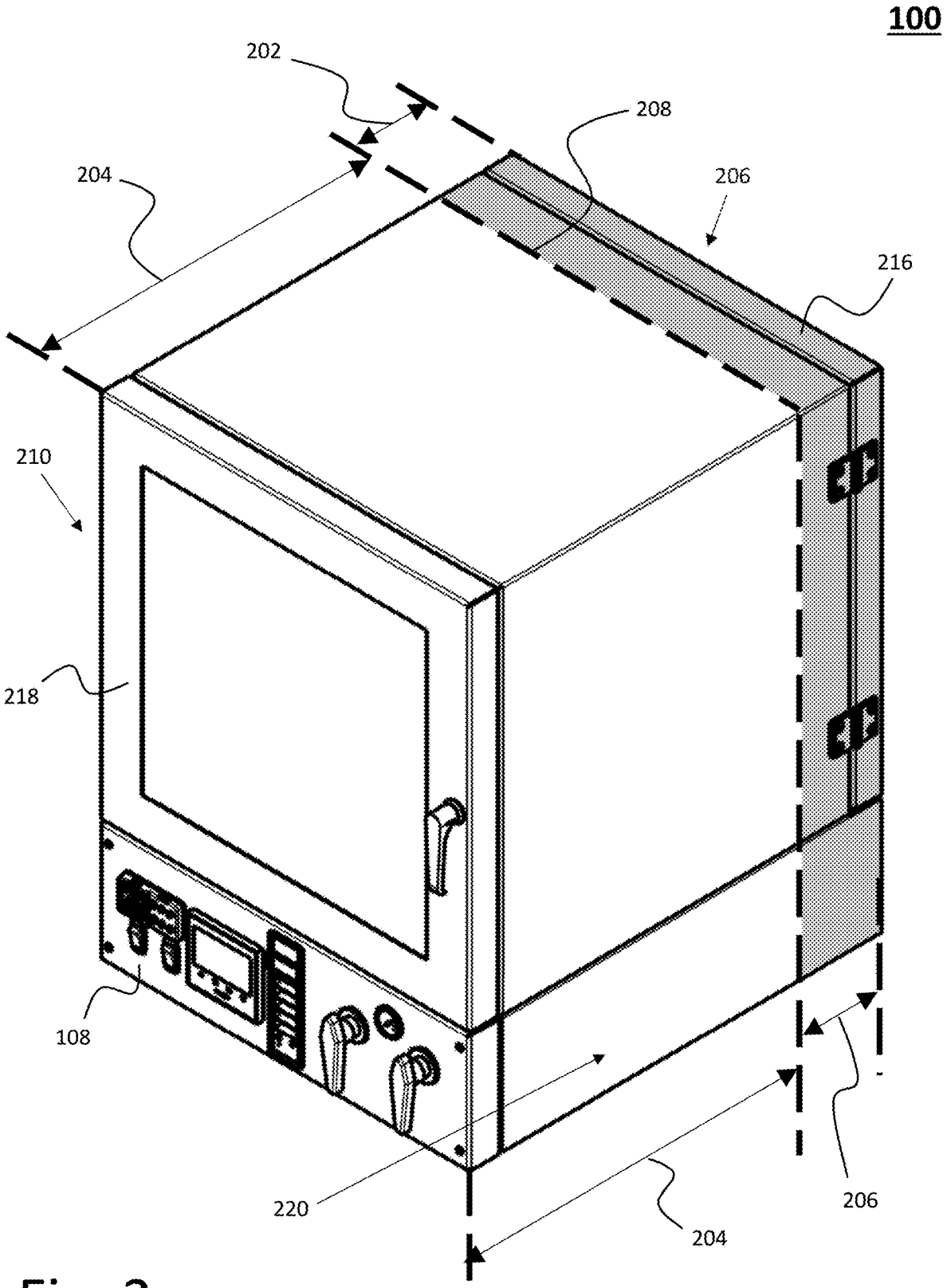
FIG. 2 is an isometric three-quarters view of vacuum oven showing a front face of the vacuum oven, according to some embodiment of the present invention.
Figure 3:
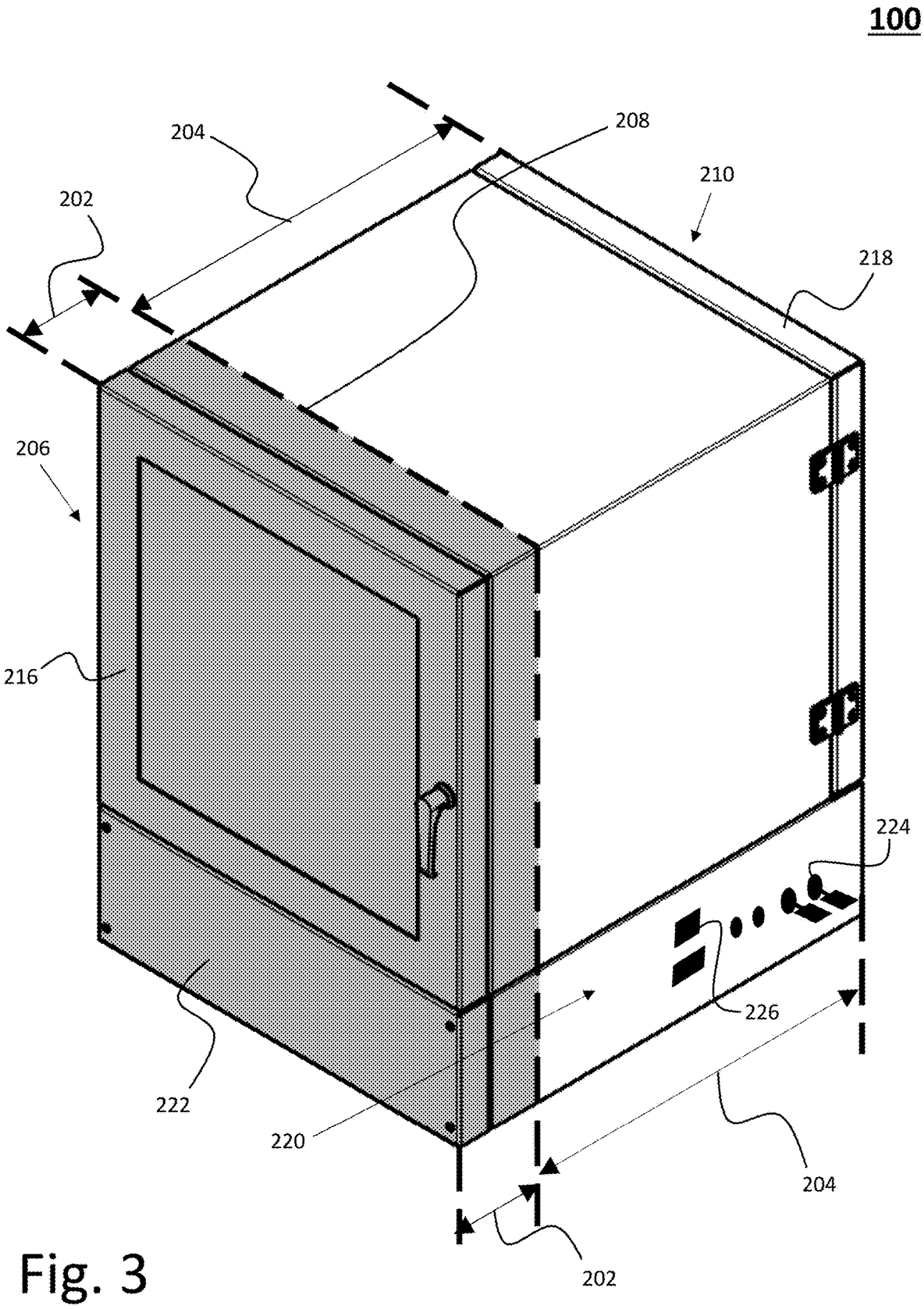
FIG. 3 is an isometric three-quarters view of the vacuum oven showing a rear face of the vacuum oven, according to some embodiment of the present invention.
Figure 4:
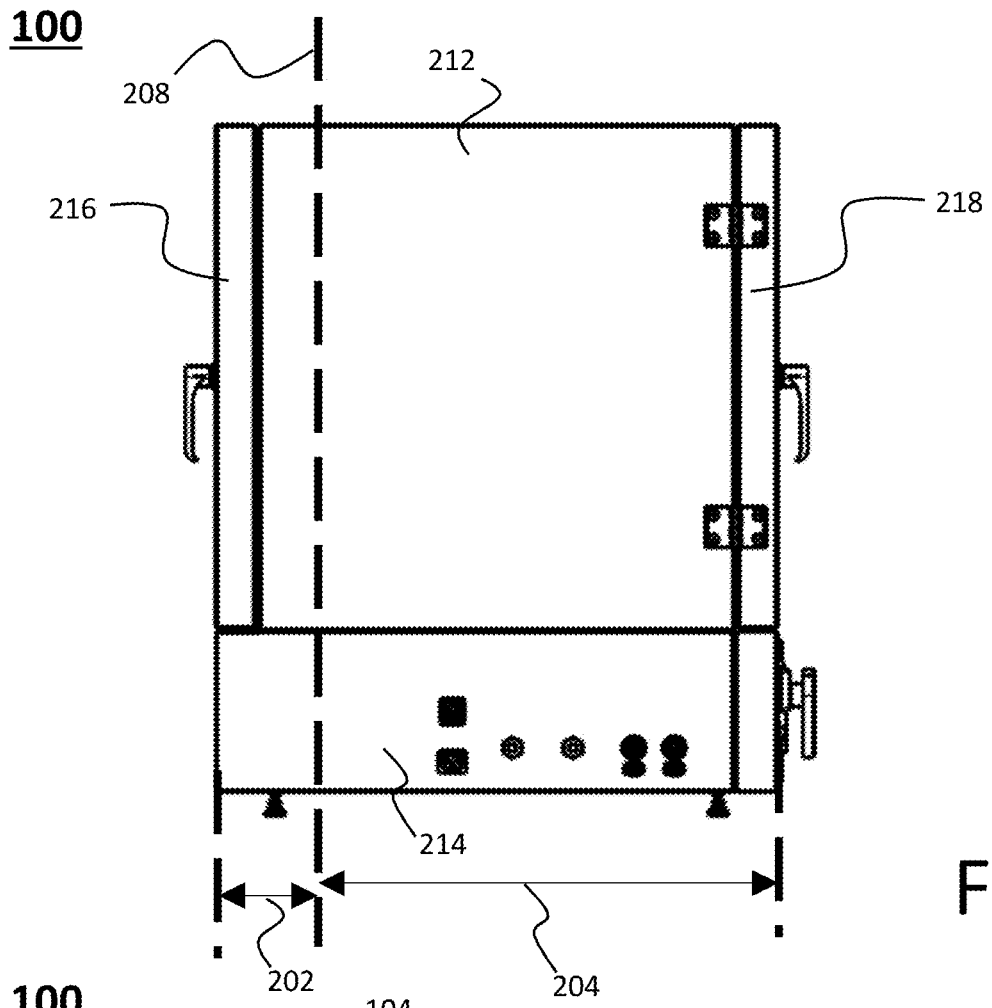
FIG. 4 is a side view of the vacuum oven from the left side, according to some embodiments of the present invention.
Figure 5:
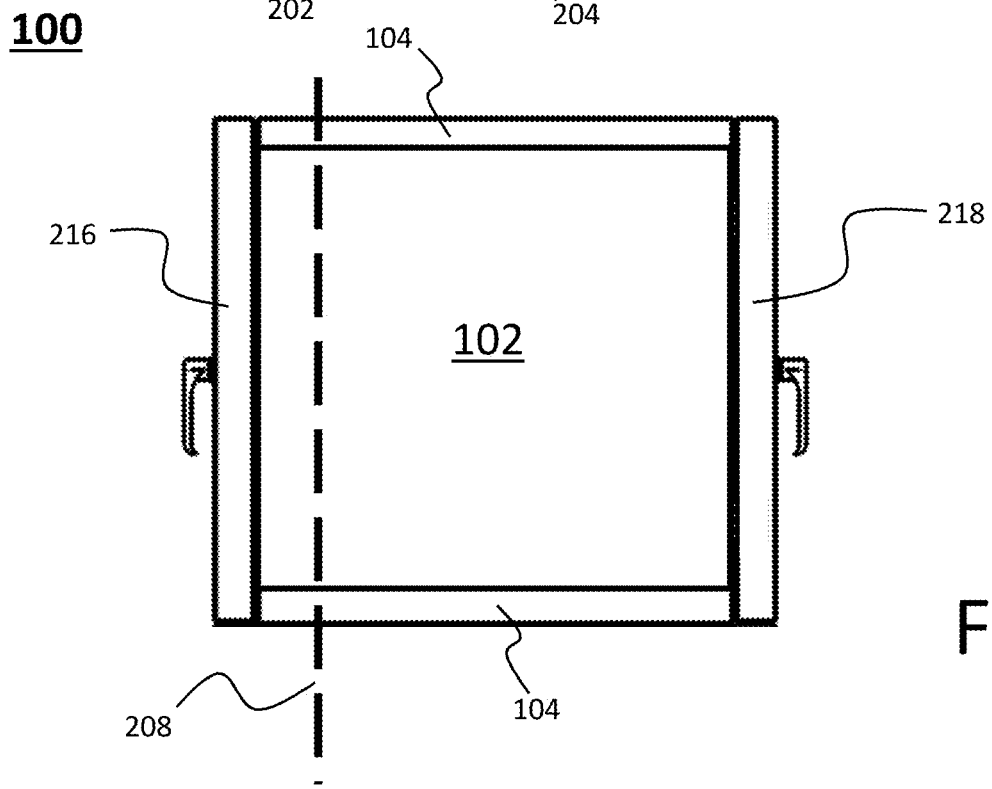
FIG. 5 is a cross-sectional view of the vacuum oven, illustrating the inner cavity, according to some embodiments of the present invention.
Figure 6:
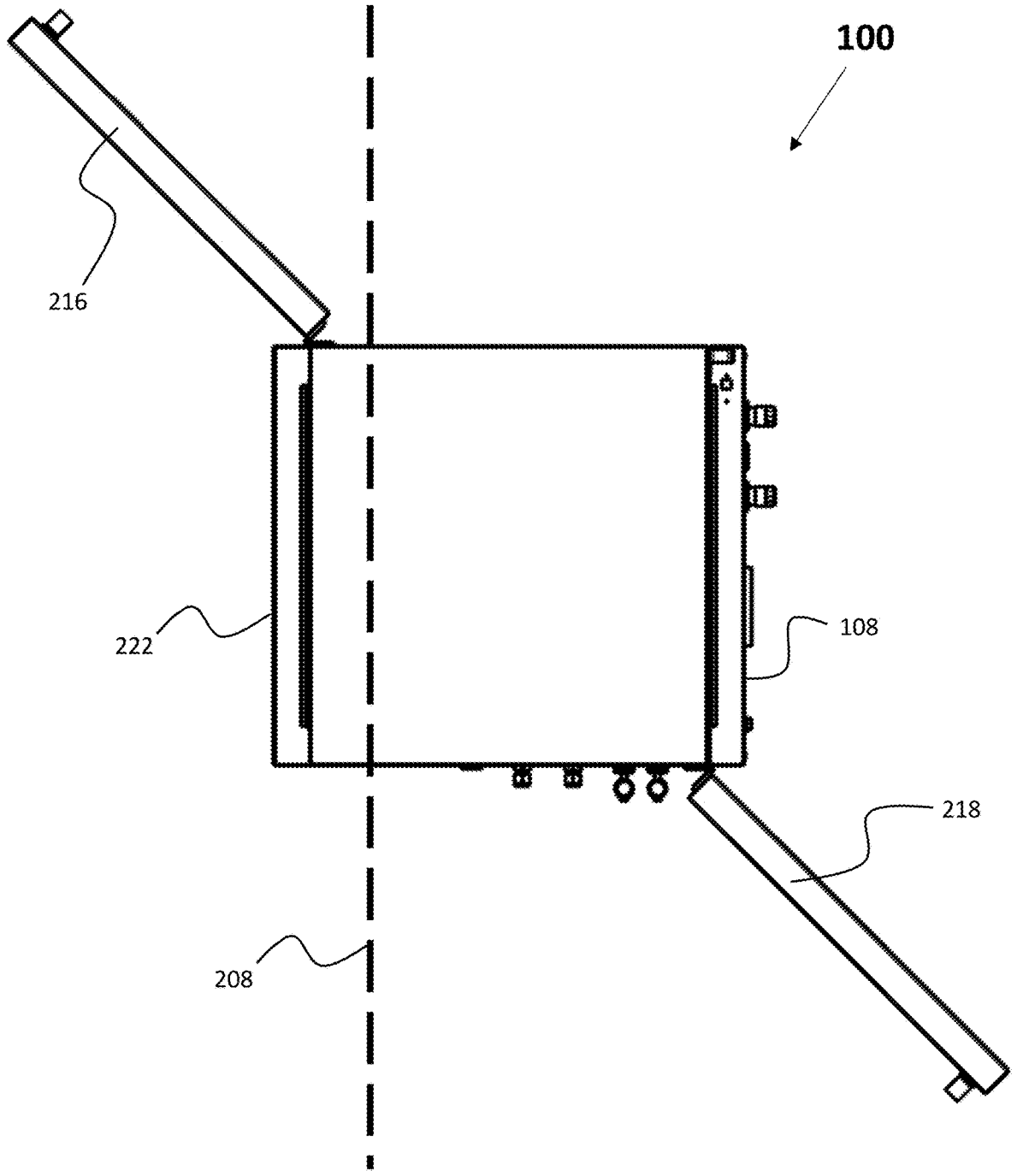
FIG. 6 is a top view of the vacuum oven with the front door and the back door open, according to some embodiments of the present invention.
Figure 7:
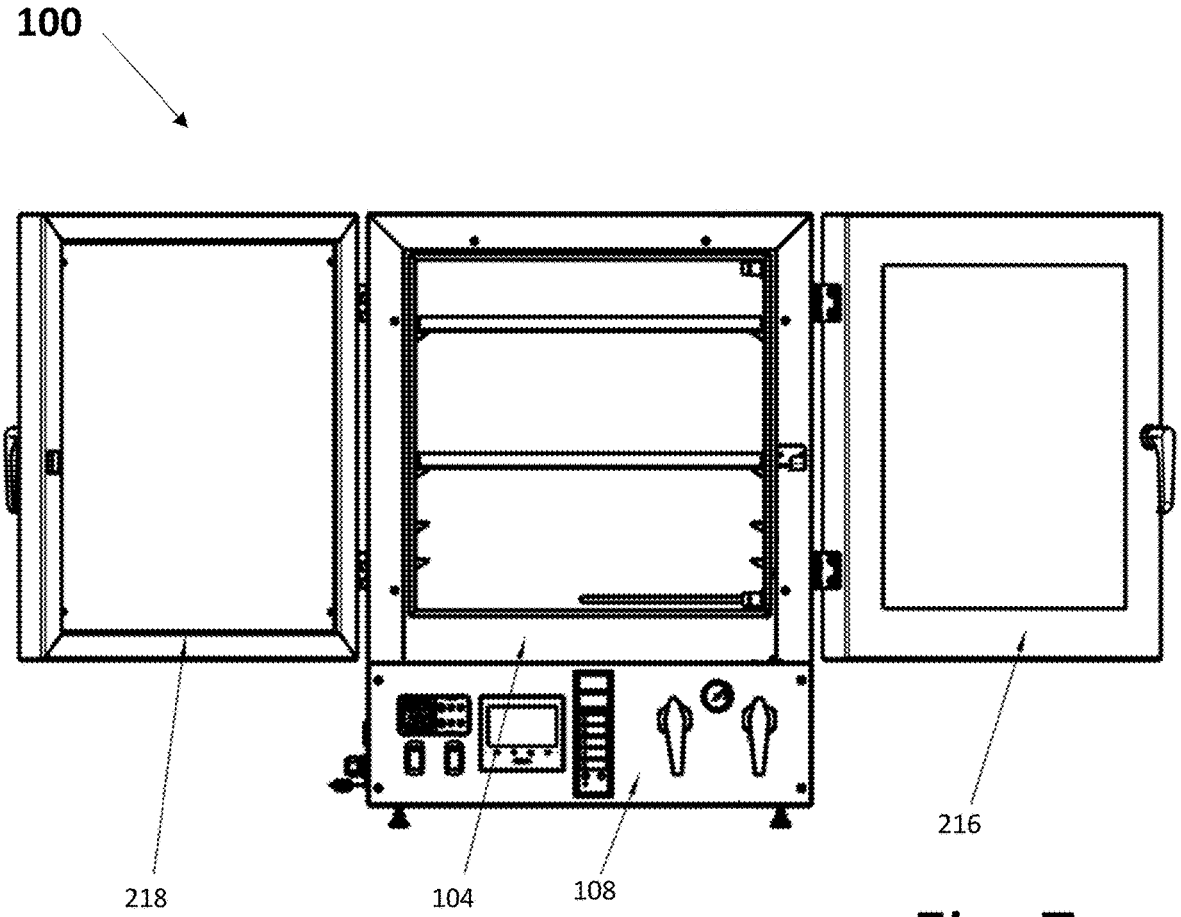
FIG. 7 is a front view of the vacuum oven with the front door and the back door open according to some embodiments of the present invention.

FIG. 2 is an isometric three-quarters view of a vacuum oven 100 showing a front face of the vacuum oven, according to some embodiment of the present invention. FIG. 3 is an isometric three-quarters view of the vacuum oven 100 showing a rear face of the vacuum oven, according to some embodiment of the present invention. FIG. 4 is a side view of the vacuum oven from the left side, according to some embodiments of the present invention. FIG. 5 is a cross-sectional view of the vacuum oven, illustrating the inner cavity, according to some embodiments of the present invention. FIG. 6 is a top view of the vacuum oven with the front door and the back door open, according to some embodiments of the present invention. FIG. 7 is a front view of the vacuum oven with the front door and the back door open according to some embodiments of the present invention.

The vacuum oven 100 has a rear portion 202 and a front portion 204. The rear portion 202 extends from a rear face 206 to an intermediate location 208, while the front portion 204 extends from the front face 210 to the intermediate location 208. In FIGS. 2 and 3, the rear portion 202 is illustrated in gray for clarity purposes only. The rear portion 202 does not have any electrical components, which permits the rear portion 202 to be inside a hazardous environment. The front portion 204 includes electrical components.

The vacuum oven includes a top section 212 and a bottom section 214. The top section 212 includes the inner cavity 102, the wall 104 surrounding the inner cavity, a rear door 216, and a front door 218. The front door 218 covers a front side of the inner cavity, while the back door 216 covers a rear side of the inner cavity opposite the first side.

The bottom section 214 includes a housing 220 which covers electrical equipment. The housing includes a rear panel 222 covering the rear face of the housing 220, and a control panel 108 covering the front face of the housing 220. The rear panel 222 is joined to the walls of the housing 220 hermetically to prevent passage of passage of hazardous gases from the hazardous environment into the housing. The control panel 108 enables control of the oven from the front of the oven, which is placed in a non-hazardous environment.

Is some embodiments of the present invention, the housing 220 includes at least data outlet 224 configured for being connected to at least one external device configured for receiving machine-readable data. The housing may include other outlets as well, such a power outlet 226. The outlets are electrical components and are therefore on the front portion 204 of the oven 100.

The vacuum oven 100 enables a user to transition a first material treated with a hazardous material directly into the vacuum oven 100 from the back door 216, without having to leave the hazardous classified environment to access the oven 100. When the front door and back door are closed, the hazardous material is vaporized by raising the temperature of the inner cavity and lowering the pressure within the inner cavity, such that to the pressure within the inner cavity is lower than a vapor pressure of the hazardous material at the temperature of the inner cavity. The vaporized hazardous material is led out of the inner cavity by the vacuum pump. After the removal of the vaporized hazardous material from the inner cavity 102, pressure is brought back to atmospheric pressure in the vacuum oven, and the front door 218 of the vacuum oven is opened, allowing removal of the first material in an environment that is not classified for hazardous material.

Figure 8:
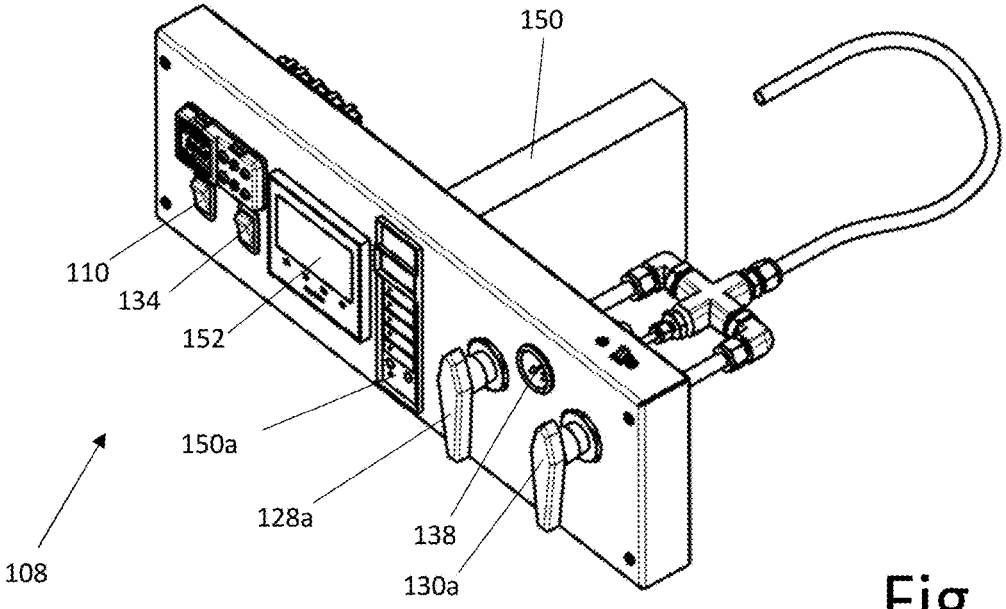
FIG. 8 is an isometric view of the control panel of the vacuum oven, according to some embodiments of the present invention.

FIG. 8 is an isometric view of the control panel 108 of the vacuum oven 100, according to some embodiments of the present invention.

As mentioned above, the front of the control panel includes the regulators 128*a* and 130*a*, the dial of the pressure sensor 138, the switches 110 and 134. In some embodiments of the present invention, the front of the control panel includes a gas monitor 150 connected to the gas sensor(s) 140 described above. The gas monitor 150 is configured to process the data from the gas sensor(s) 140 and display on an output display 150*a* of the gas sensor a measurement of the concentration of hazardous in the inner cavity 102. The gas monitor 150 may be, for example a 580A Dual-Channel Combustible Gas Monitor manufactured by MSA. In some embodiments of the present invention, the control panel 108 includes a temperature display 152 connected to a temperature sensor (to be discussed further below) measuring temperature inside the inner cavity 102. In this manner, a user looking at the control panel can read the pressure, temperature, and hazardous gas concentration in the inner cavity, and operate the oven according to the readings.

Figure 9:
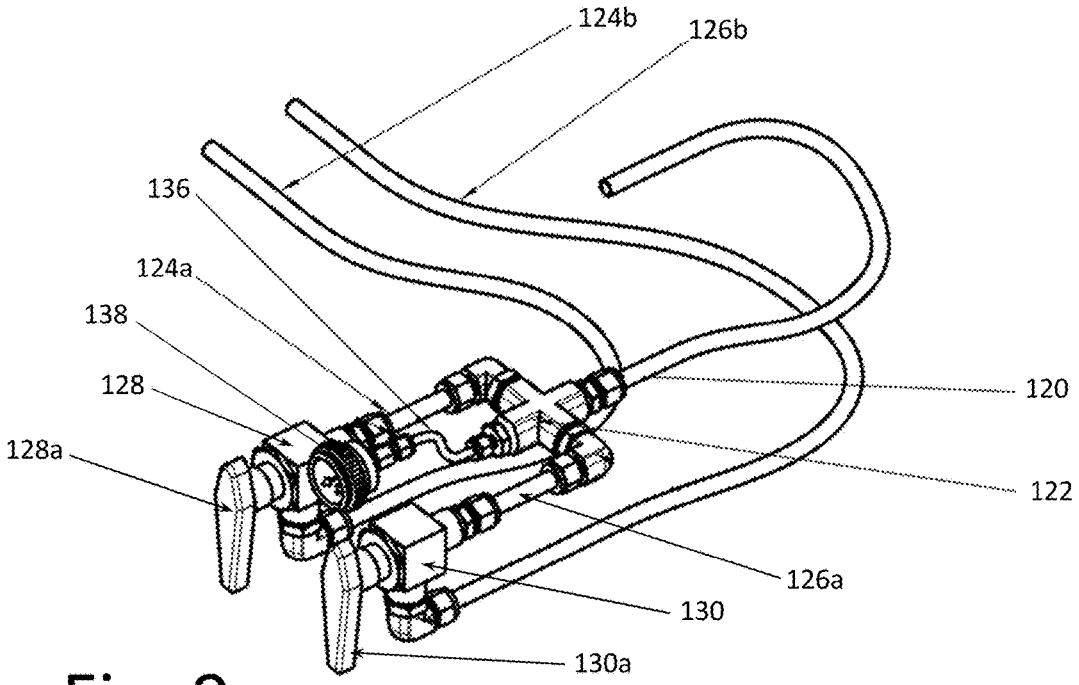
FIG. 9 is an isometric view of the pipes connected to the control panel, according to some embodiments of the present invention.

FIG. 9 is an isometric view of the pipes connected to the control panel, according to some embodiments of the present invention.

In the example of FIG. 9, the first duct 124 has a first section 124*a* between the manifold 122 and the first valve 128 and a second section 124*b* between the first valve 128 and the vacuum pump. In some embodiments of the present invention, the first section 124*a* is rigid, and may be make of a rigid plastic or a metal, for example. In some embodiments of the present invention, the second section 124*b* is flexible, and may be made, for example, of silicon or rubber. Similarly, the second duct 126 has a first section 126*a* between the manifold 122 and the second valve 130 and a second section 126*b* between the second valve 130 and the external environment. In some embodiments of the present invention, the first section 126*a* is rigid, and may be make of a rigid plastic or a metal, for example. In some embodiments of the present invention, the second section 126*b* is flexible, and may be made, for example, of silicon or rubber. In some embodiments of the present invention, the third duct 136 is flexible and may be made, for example, of silicon or rubber. The tube 120 is optionally flexible and may be made, for example, of silicon or rubber.

Figure 10:
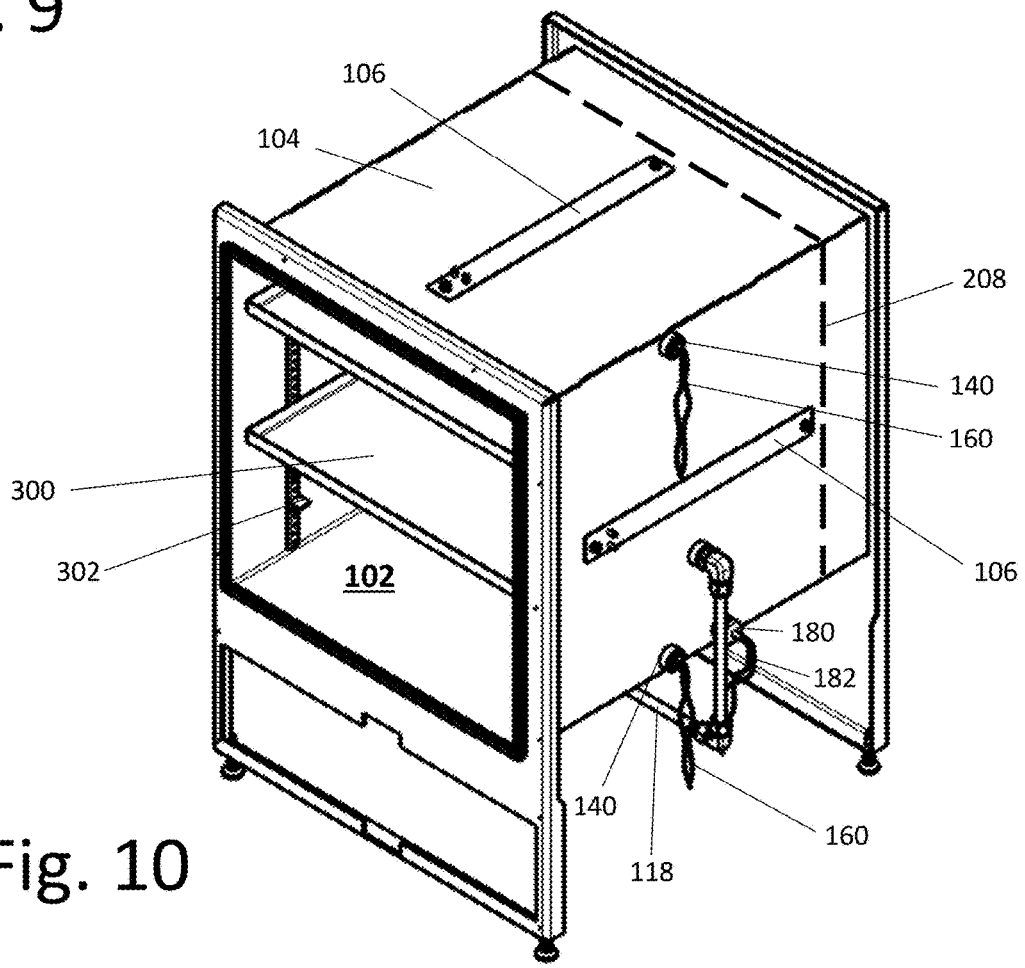
FIG. 10 is an isometric view of the oven, illustrating heating elements and sensors, according to some embodiments of the present invention.

FIG. 10 is an isometric view of the oven 100, illustrating heating elements and sensors, according to some embodiments of the present invention.

In some embodiments of the present invention, the oven includes one or more gas sensors 140, each gas sensor 140 having a sensing end extending inside the inner cavity 102 and a data generating end is located outside the inner cavity 102. The sensing end is placed into the inner cavity via an opening on the wall 104 of the inner cavity 102. The opening is hermetically closed by the gas sensor 140 such that air flow via the opening is prevented. The gas sensor includes first wiring 160, configured for leading data from the data generating end to the gas monitor described above/and or to one or more data outlets, as described above. The first wiring 160 is outside the inner cavity.

Similarly, in some embodiments of the present invention, the oven includes one or more temperature sensors 180, each temperature sensor 180 having a temperature sensing end extending inside the inner cavity 102 and a data generating end is located outside the inner cavity 102. The sensing end is placed into the inner cavity via an opening on the wall 104 of the inner cavity 102. The opening is hermetically closed by the temperature sensor 180 such that air flow via the opening is prevented. The temperature sensor 180 includes second wiring 182, configured for leading data from the data generating end to the a temperature display described above/and or to one or more data outlets, as described above. The second wiring 182 is outside the inner cavity.

In some embodiments of the present invention, one or more trays 300 are placed in the inner cavity 120 in order to hold material inserted into the cavity. The trays 300 are supported by one or more respective tray supports 302 joined to the inner surface of the wall 104.

Figure 11:
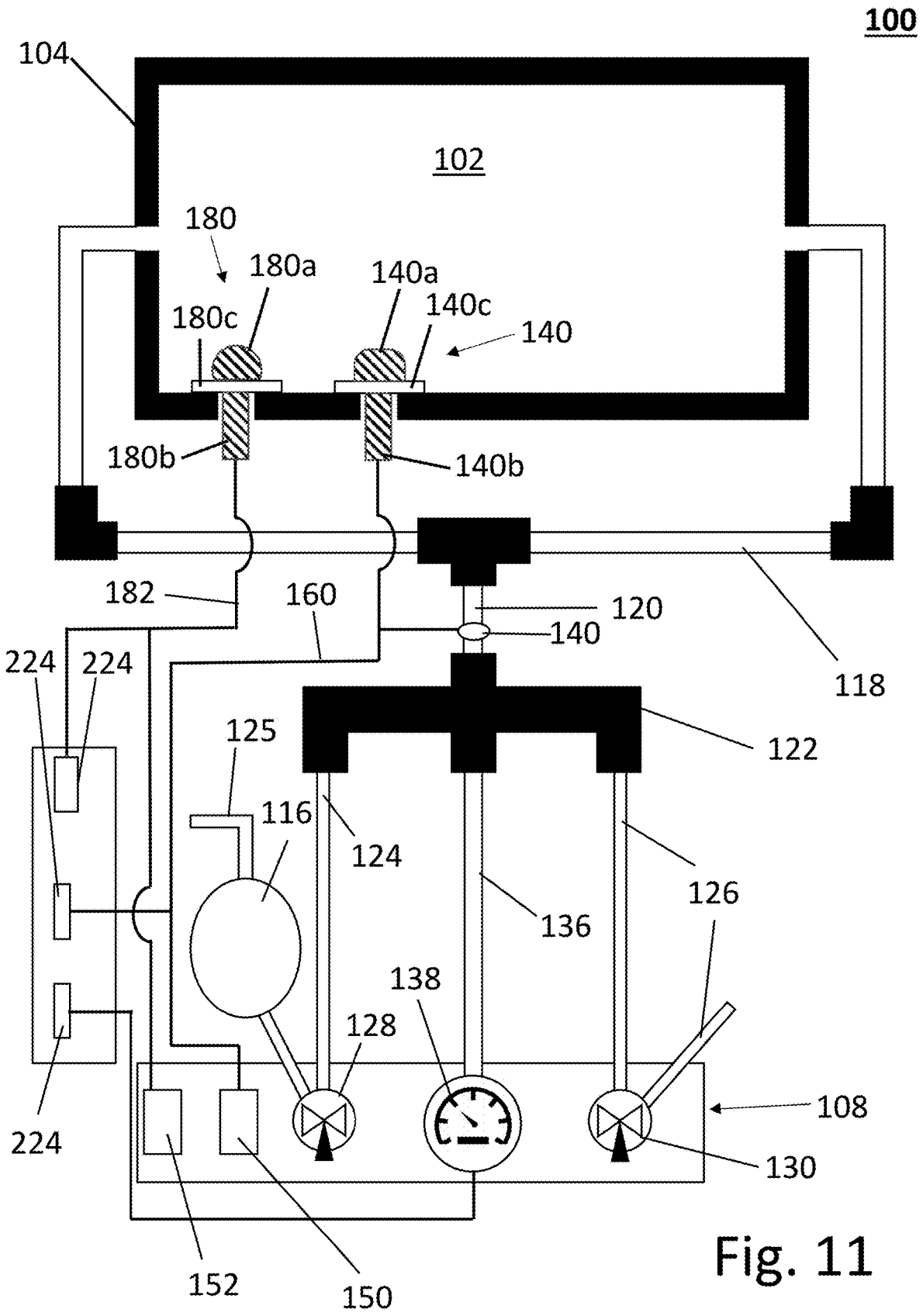
FIG. 11 is a schematic drawing illustrating electrical connections outside the inner cavity, for leading temperature data and gas concentration data to data outlets and/or to respective displays, according to some embodiments of the present invention.

FIG. 11 is a schematic drawing illustrating electrical connections outside the inner cavity 102, for leading temperature data and gas concentration data to data outlets and/or to respective displays, according to some embodiments of the present invention.

The oven 100 includes a gas sensor 140 having a gas sensing end 140*a*, a first data generating end 140*b*, and a sealing section 140*c*. The gas sensing end is located inside the inner cavity 102 and is configured to measure the concentration of one or more hazardous (e.g., combustible) gases in the inner cavity. The first data generating end 140*b* has an output end located outside the inner cavity 102. The first data generating end is configured to receive the measurement from the gas sensing end and to generate therefrom gas data indicative of concentration of one or more hazardous gases. The output end of the first data generating end is connected to first electrical wiring 160, which leads the gas data to a respective data outlet 224 and/or to the gas monitor 150. The sealing section 140*c* seals the opening on the wall 104 which is traversed by the gas sensor, to prevent fluid propagation between the inner cavity and the outside environment through the opening traversed by the gas sensor.

The oven 100 includes a temperature sensor 180 having a temperature sensing end 180*a*, a second data generating end 180*b*, and a sealing section 140*c*. The gas sensing end is located inside the inner cavity 102 and is configured to measure the temperature in the inner cavity. The second data generating end 180*b* has an output end located outside the inner cavity 102. The second data generating end 180*b* is configured to receive the measurement from the temperature sensing end and to generate therefrom temperature data indicative of the temperature inside the inner cavity 102. The output end of the second data generating end is connected to second electrical wiring 182, which leads the temperature data to a respective data outlet 224 and/or to the temperature display 152. The sealing section 180*c* seals the opening on the wall 104 which is traversed by the temperature sensor, to prevent fluid propagation between the inner cavity and the outside environment through the opening traversed by the temperature sensor.

Figure 12:
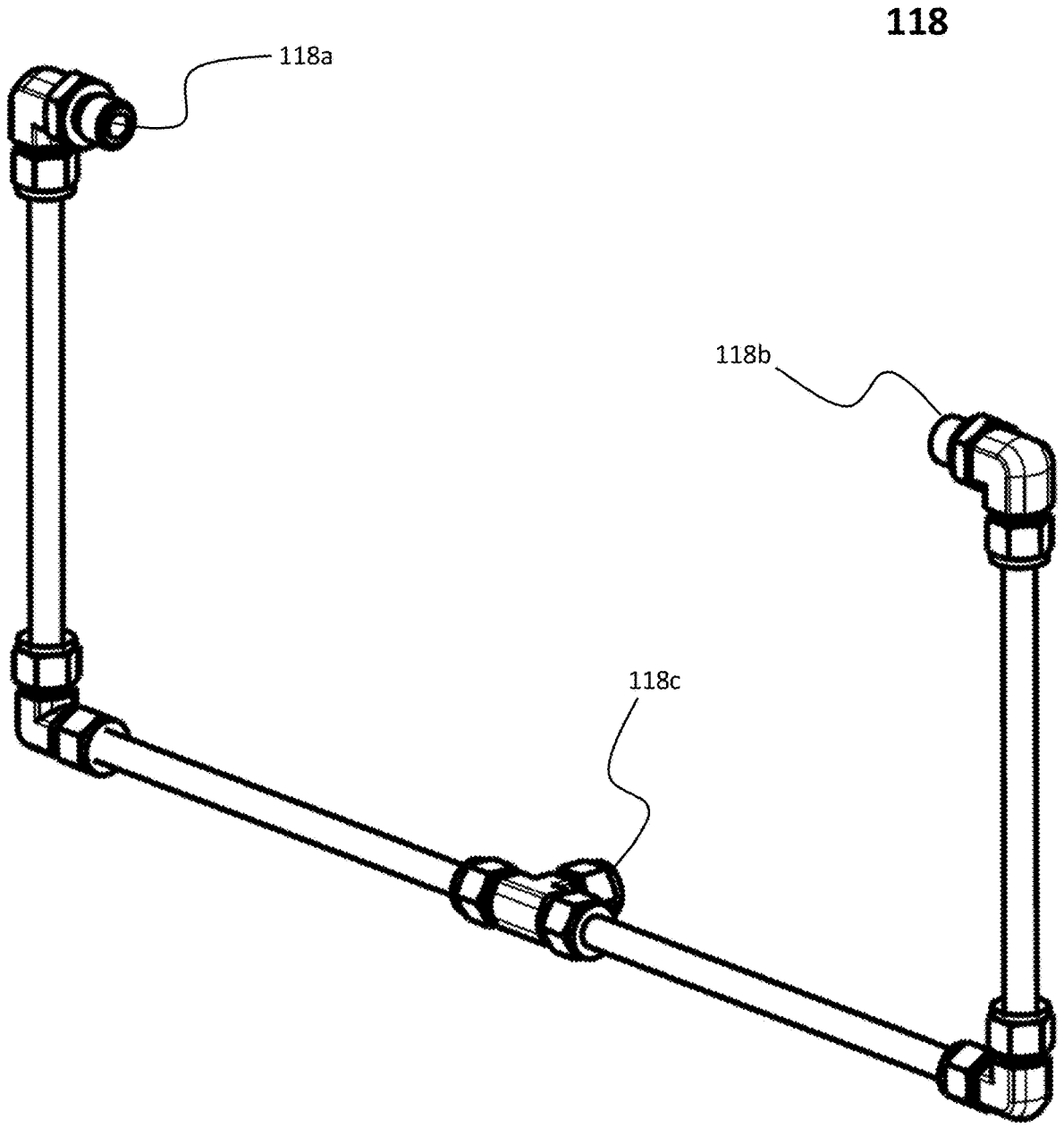
FIG. 12 illustrates an example of the pipe in fluid communication with the inner cavity of the vacuum oven, according to some embodiments of the present invention.

FIG. 12 illustrates an example of the pipe 118 in fluid communication with the inner cavity of the vacuum oven, according to some embodiments of the present invention.

The pipe 118 includes two first ends 118*a* and 118*b*, and a second end 118*c*. The first ends 118*a* and 118*b* are configured to be are hermetically joined to the openings 102*a* of the inner cavity wall described in FIG. 1, so that the pipe 118 is in fluid communication with the inside of the pipe 118. The second end 118*c* is configured to be connected to and in fluid communication with the tube 120 of FIGS. 1 and 9. In non-limiting embodiments of the present invention, the pipe 118 is rigid or semi-rigid, and may, for example, include plastic and/or metal.

Figure 13:
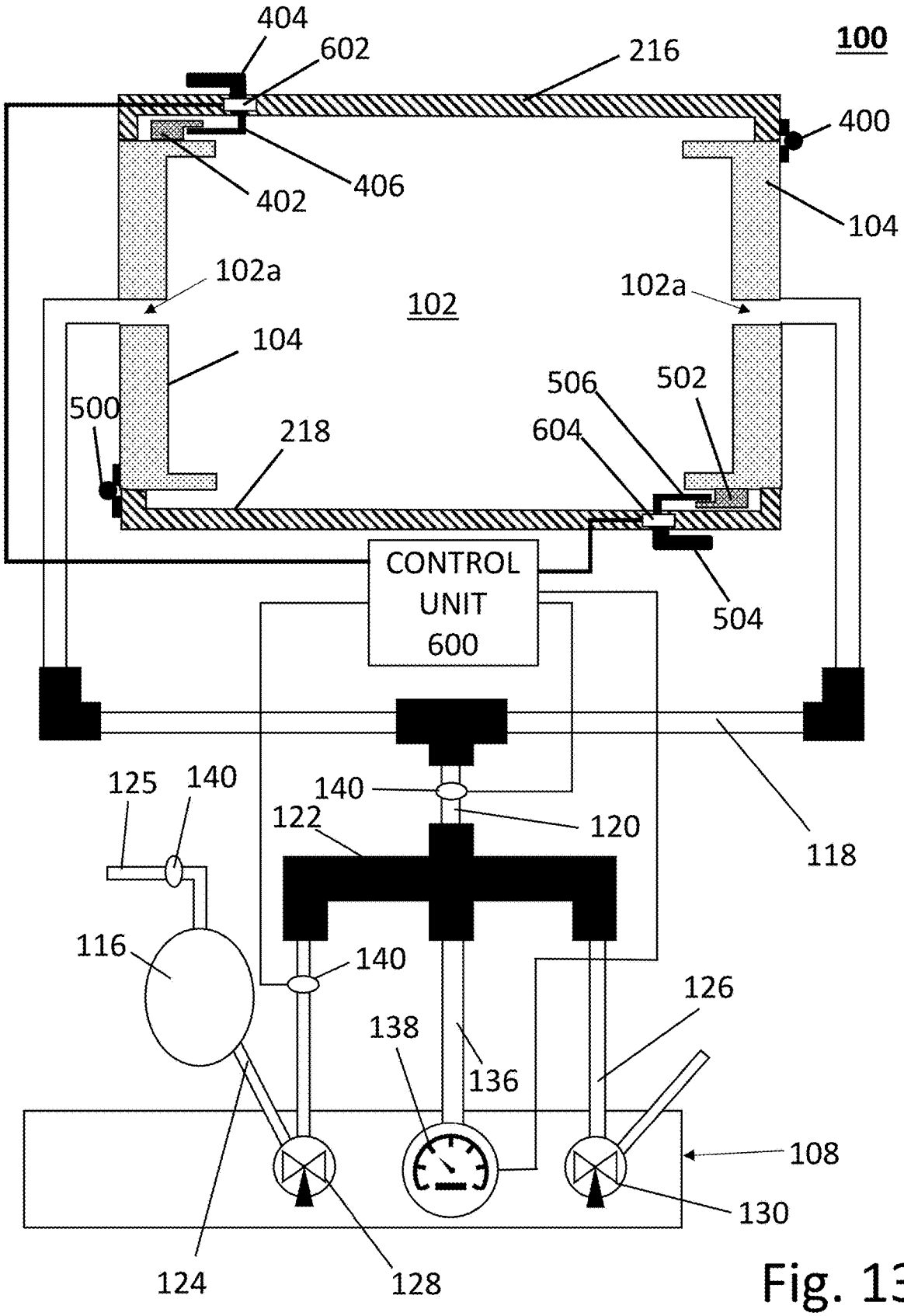
FIG. 13 is a schematic drawing illustrating a closure and locking mechanism of the doors of the oven, according to some embodiments of the present invention.

FIG. 13 is a schematic drawing illustrating a closure and locking mechanism of the doors of the oven 100, according to some embodiments of the present invention;

In the example of FIG. 13, the back door 216 is joined to the wall 104 of the inner cavity 102 via a hinge 400. A rear locking flange 402 is joined to a rear flange extending from the lateral side of the wall 104 opposite to the lateral side of the wall 104 joined to the hinge 400. The back door 216 includes a rear handle 404 extending outward from the outer surface of the back door. The rear handle 404 is joined to a rear locking extension 406 extending inward from an inner surface of the door (i.e., the surface of the rear door which faces the inner cavity). When the rear door is closed and the rear handle 404 is rotated, the rear locking extension 406 rotates as well and cooperates with the rear locking flange 402 to prevent the rear door from opening, thereby locking the rear door.

The front door 218 is joined to the wall 104 of the inner cavity 102 via a second hinge 500. A front locking flange 502 is joined to a front flange extending from the lateral side of the wall 104 opposite to the lateral side of the wall 104 joined to the second hinge 500. The front door 218 includes a front handle 504 extending outward from the outer surface of the front door. The front handle 504 is joined to a front locking extension 506 extending inward from an inner surface of the front door (i.e., the surface of the front door which faces the inner cavity). When the front door is closed and the front handle 504 is rotated, the front locking extension 506 rotates as well and cooperates with the front locking flange 506 to prevent the front door from opening, thereby locking the front door.

In some embodiments of the present invention, the oven 100 includes a control unit 600, which is connected to a rear interlock 602 and a front interlock 604. The rear interlock 602, when engaged is configured for preventing the unlocking of the front door (when the front door is closed) and of the back door (when the back door is closed) during the operation of the oven 100 or when conditions inside the oven 102 are different from permitted conditions.

In some embodiments of the present invention, the control unit is configured to receive pressure data from the pressure sensor 138. The control unit 600 is configured to engage the rear interlock and front interlock when the pressure in the inner cavity is below a first threshold pressure value, and to disengage the rear interlock and the front interlock when the pressure in the inner cavity is above a second threshold pressure value. The first threshold pressure value and the second threshold pressure value may be the same.

In some embodiments of the present invention, the control unit 600 is configured to receive gas data from the gas sensor(s) 140. The control unit 600 is configured to prevent the opening of the front door 218 (by causing the front interlock 604 to engage) if the concentration of hazardous gases in the inner cavity is above a certain concentration threshold, and to allow the opening of the front door 218 (by causing the front interlock 604 to disengage) if the concentration of hazardous gases in the inner cavity is below the concentration threshold. The threshold may be, for example 25% LEL (Lower Explosive Level), 15% LEL, 10% LEL. In some embodiments of the present invention, control unit also causes the rear door interlock 602 to engage when the hazardous gas concentration is above the concentration threshold (thereby preventing the unlocking of the rear door) and to disengage when the hazardous gas concentration is below the concentration threshold (thereby allowing the unlocking of the rear door).

It should be noted that when the front door and the rear door are locked, the front door and rear door hermetically close the front side and the rear side of the inner cavity, and prevent passage of fluids into or out of the inner cavity through the front side and the rear side of the inner cavity.

Figure 14:
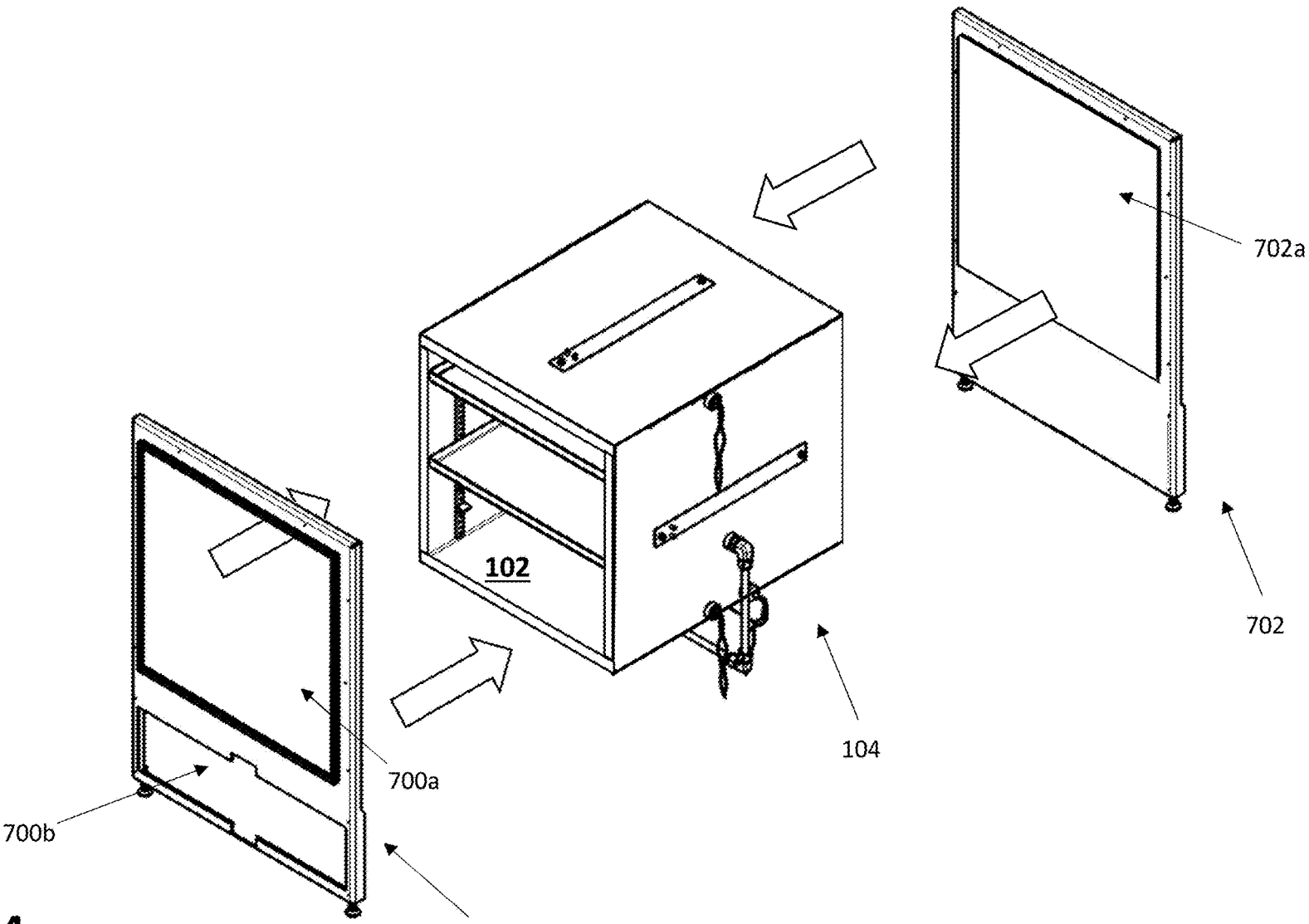
FIGS. 14-16 illustrate an assembly of the oven, according to some embodiments of the present invention.
Figure 15:
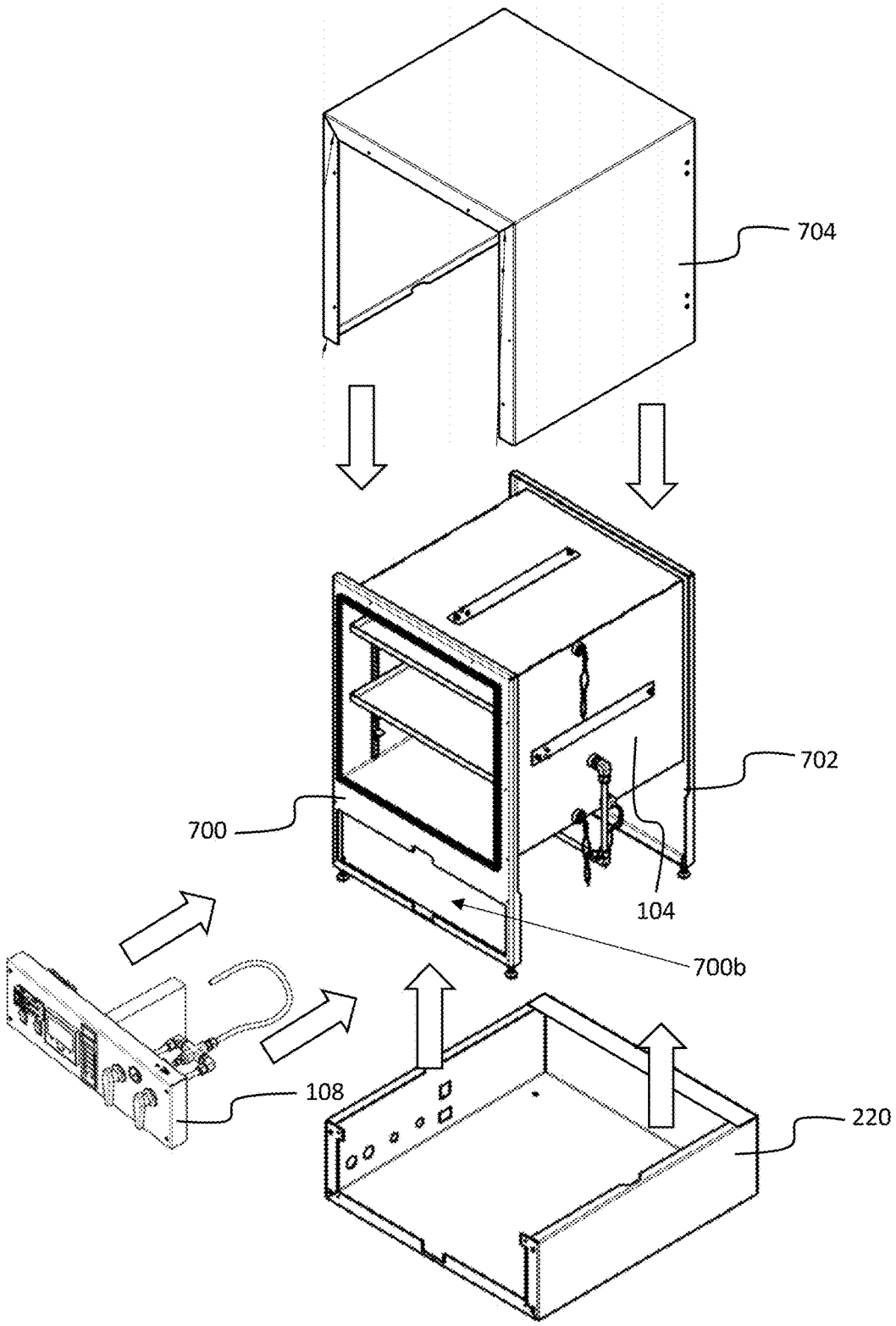
Figure 16:
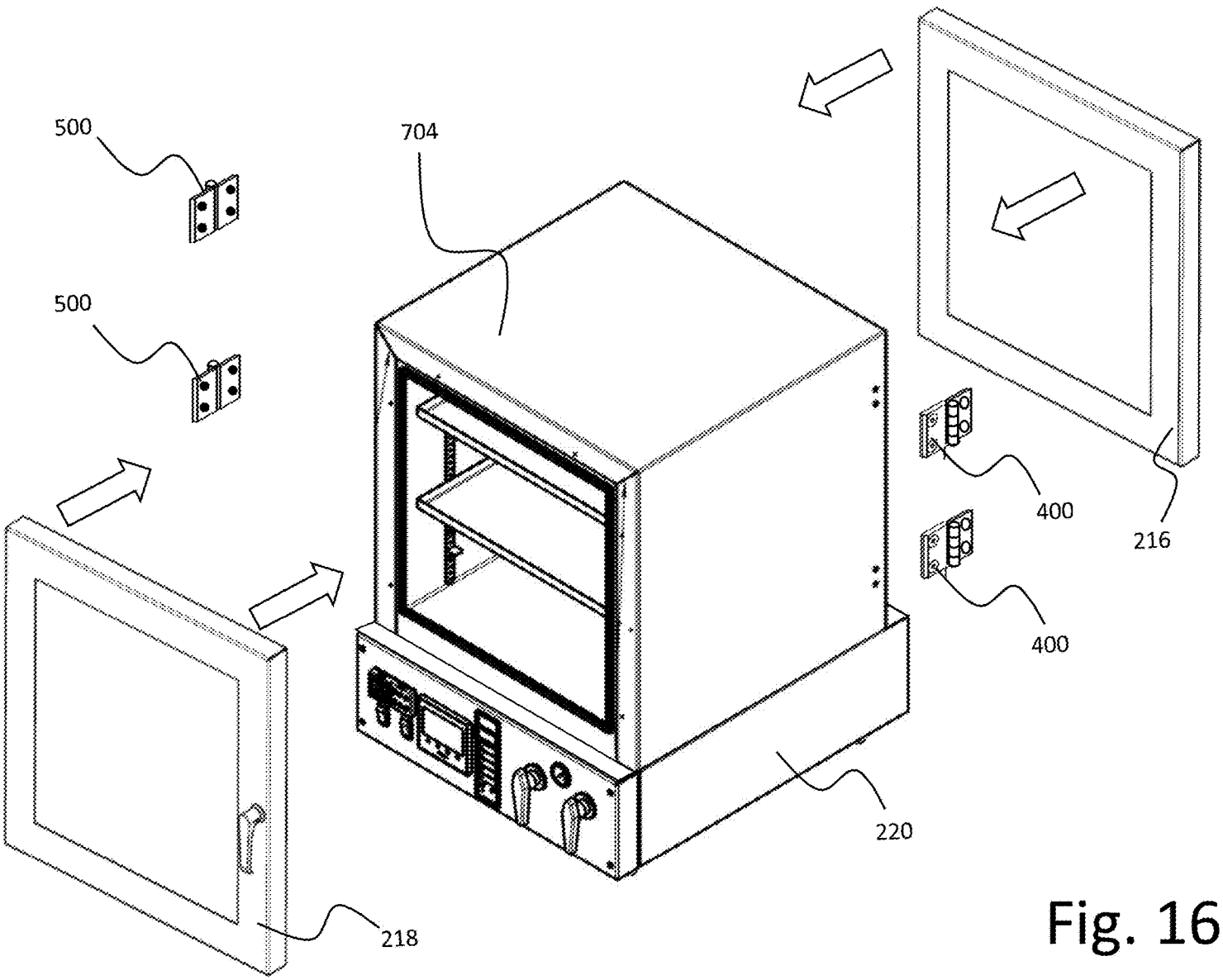

FIGS. 14-16 illustrate an assembly of the oven 100, according to some embodiments of the present invention.

In FIG. 14, after the wall 104 of the inner cavity is fitted with the necessary sensors, pipes, and heating elements, a front frame 700 having a first aperture 700*a* and a second aperture 700*b* is slid over the wall 104 so that a portion of the wall 104 traverses the first aperture 700*a*. Similarly, a rear frame 702 having an aperture 702*a* slid over the wall 104 so that a portion of the wall 104 traverses the aperture 702*a*.

In FIG. 15, a three-sided sheath 704 is slid over the front frame 700 and the rear frame 702, to cover the outer surface of the wall 104 from the top and from the two lateral sides, thereby covering the electrical element joined to the wall 104. All the fluid and electrical connections are made between elements of the control panel 108 and elements joined to the wall 104. Then the housing 200 is slid upward over the bottom section of the front frame and the rear frame. The control panel is then slid through the second aperture 700*b* of the front frame 700.

Figure 17:
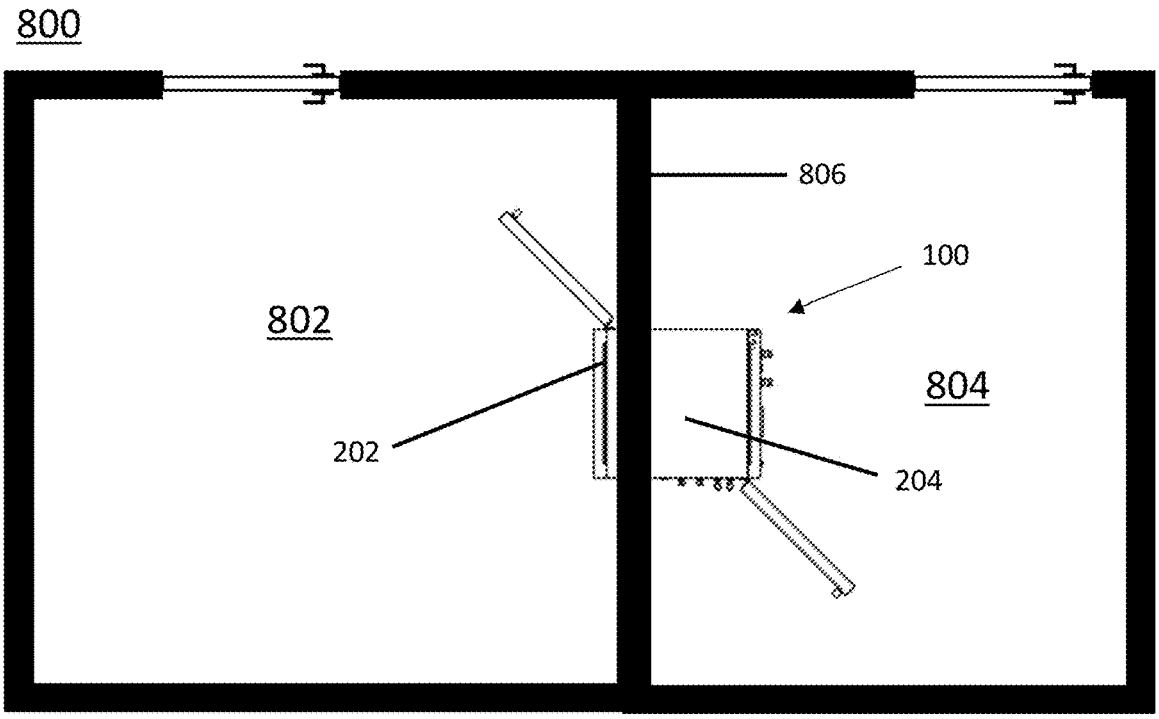
FIGS. 17-20 illustrate the vacuum oven of FIG. 1 embedded within a wall, as part of a system for treatment of a first material with at least one hazardous material.
Figure 18:
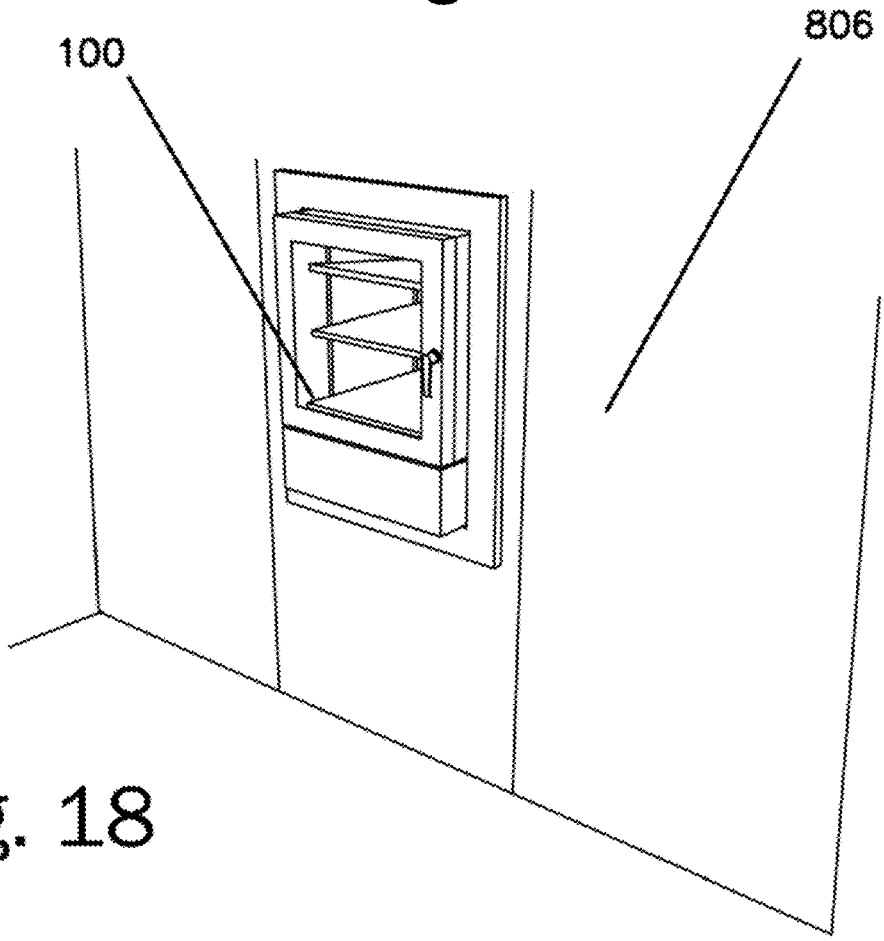
Figure 19:
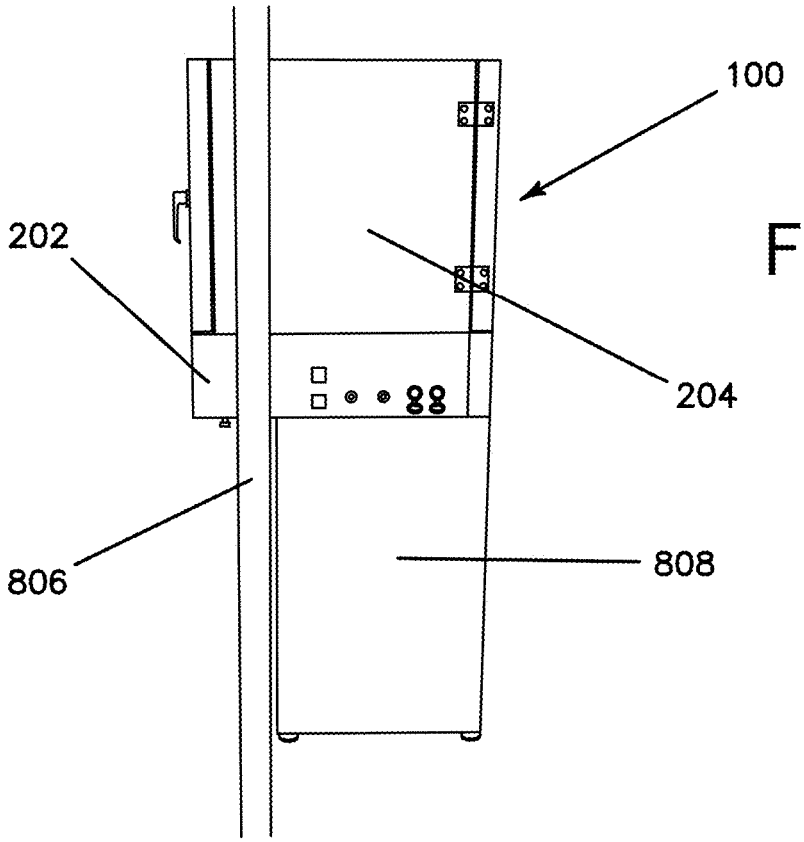
Figure 20:
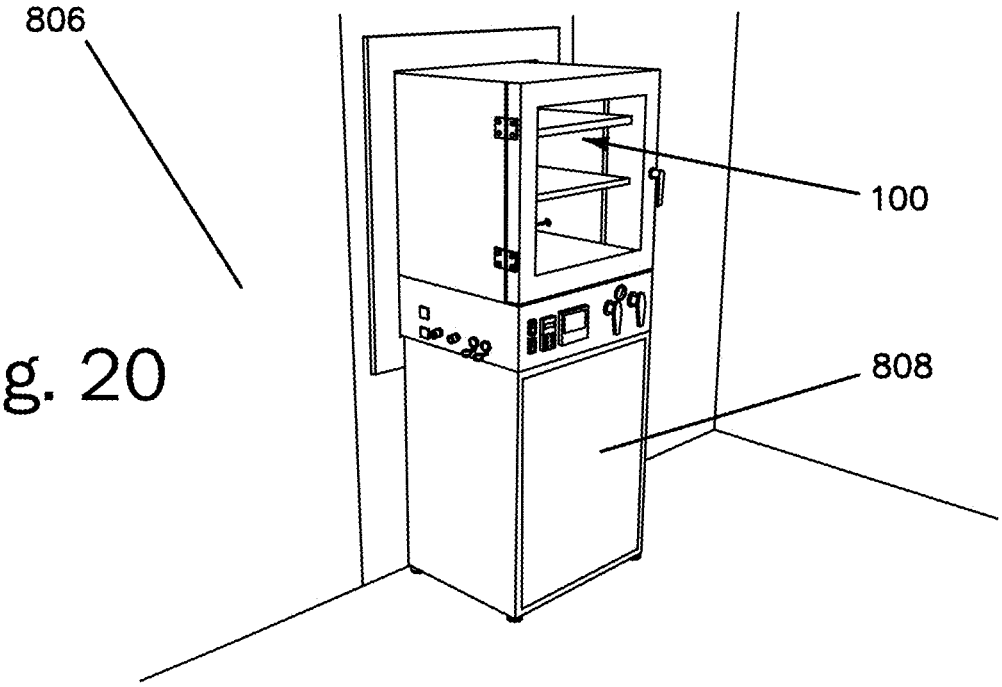

In FIG. 17, the rear door 216 and the front door 218 are joined to the three-sided sheath 704 via hinges 400 and 500, respectively.

FIGS. 17-20 illustrate the vacuum oven of FIG. 1 embedded within a wall, as part of a system 800 for treatment of a first material with at least one hazardous material.

The system 800 includes a manufacturing room 802, a holding room 804, and the vacuum oven 100. The manufacturing room is configured according to safety standards to hold at least one hazardous material in liquid form (for example, according to NFPA 30, as explained above), and is configured for the treatment of a material using the at least one hazardous material as a solvent. In some embodiments of the present invention, the holding room is configured to hold a flammable vapor of the hazardous material above ignitable concentration (for example, as a C1D1 or C1D2 location according for NFPA 70) as well. The holding room is not configured according to the safety standards, and therefore is not configured for holding the hazardous material or vapors thereof. The manufacturing room and the holding room are separated by a wall 806. The oven 100 is hermetically embedded in the wall 806, such that the manufacturing room and the holding room are not in fluid communication with each other.

The oven 100 is embedded in the wall 806 such that the rear portion 202 is located in the manufacturing room and the front portion 204 is located in the holding room. In this manner, material with the hazardous solvent is inserted into the oven via the rear door of the oven after the material has been treated with the hazardous solvent and the rear door is closed. The oven is operated by a user in the holding room via the control panel. When the hazardous solvent has evaporated and enough vapor of the solvent has been exhausted from the oven 100, so that the concentration of the solvent's vapor is below ignitable concentration (for example, back into the manufacturing room or to another location that is configured to safely hold ignitable concentration of flammable vapors), the front door is opened in the holding room and the material is retrieved.

The system 800 enables the solvent to be removed from the treated material without the user in the manufacturing room leaving the room and carrying the material with the hazardous solvent out of the manufacturing room. The system 800 therefore simplifies and shortens the process of removing a hazardous solvent from the material treated by such solvent.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

What is claimed is:

1. A system for treatment of a first material with at least one hazardous material, the system comprising:

a manufacturing room configured according to first safety standards to hold at least one hazardous material, the manufacturing room being configured for the treatment of the first material using the at least one hazardous material as a solvent;

a holding room not configured according to the first safety standards, the holding room being separated from the manufacturing room by a wall common to the manufacturing room and the holding room;

a vacuum oven embedded in the wall, having a rear portion in the manufacturing room and a front portion in the holding room, the vacuum oven comprising:

an inner cavity configured for holding the first material treated with the at least one hazardous material, the inner cavity being surrounded by a housing;

an electrically powered heating element configured to heat the inner cavity, the heating element being joined to an outer surface of the housing and being located in the front portion of the vacuum oven;

a front door covering a front side of the inner cavity and being located in the manufacturing room;

a back door covering a rear side of the inner cavity opposite the first side and being located in the holding room;

an electrical apparatus located in the holding room, the electrical apparatus comprising an electrically powered control panel configured to receive from a user in the holding room a first input to operate the heating element and to operate the heating element according to the first input;

an electrically powered vacuum pump located in the holding room in fluid communication with to the inner cavity of the vacuum oven, the vacuum pump being configured to lower a pressure within the inner cavity wherein:

the control panel is configured to control an operation of the vacuum pump and comprises a first valve configured to control air flow from the inner cavity to the vacuum pump and a second valve configured to control air flow from an external environment into the inner cavity;

the vacuum oven is configured to receive the first material treated with the at least one hazardous material from the manufacturing room via the back door;

when both the front door and the back door are closed, the heating element is configured to be controlled by the user via the control panel to raise a temperature of the inner cavity, the vacuum pump is configured to be controlled by the user via the control panel to lower the pressure within the inner cavity, the first valve is configured to be opened to allow air flow from the inner cavity to the vacuum pump, and the second valve is closed to prevent air flow from the external environment to the inner cavity, such that the pressure within the inner cavity is lower than a vapor pressure of the hazardous material at the temperature of the inner cavity, thereby vaporizing the hazardous material, the vacuum pump being further configured to lead a vapor of the hazardous material out of the inner cavity, thereby removing at least some of the hazardous material from the first material and from the inner cavity and reducing a concentration of the vapor of the hazardous material below a predetermined ignitable concentration;

the front door is configured to be opened from holding room for removing the first material from the inner cavity following removal of the at least one hazardous material from the first material and from the inner cavity; and no electrical components of the vacuum oven extend into the manufacturing room.

2. The system of claim 1, wherein the vacuum oven comprises an interlock configured for preventing an opening of the front door and the back door during the operation of the heating element and of the vacuum pump.

3. The system of claim 1, the vacuum oven comprises:

a gas sensor configured for measuring a quantity of the vapor of the hazardous material in the air flow leaving the inner cavity due to the operation of the vacuum pump and to generate gas data indicative of the measured quantity;

an interlock configured to lock the front door;

a control unit configured to receive the gas data and connected to the interlock, the control unit being configured to release the interlock, thereby unlocking the front door, when the measured quantity is below a predetermined threshold level.

4. The system of claim 1, wherein the electrical apparatus further comprises at least one electrically powered data outlet configured for being connected to at least one external device, the data outlet being located in the holding room.

5. The system of claim 1, further comprising:

a temperature sensor configured to measure the temperature in the inner cavity and to generate temperature data indicative of the temperature in the inner cavity, the temperature sensor having a sensing end located within the inner cavity in the holding room and a data generating end located outside the inner cavity;

a temperature display located in the holding room on the control panel and configured to receive the temperature data and to display an image indicative of the temperature measured by the temperature sensor;

wiring leading from the data generating end of the temperature sensor to the temperature display, the wiring being located outside the inner cavity;

wherein the temperature sensor is joined to the housing of the inner cavity via an opening on the housing, such that the sensing end extends inside the inner cavity and the data generating end is located outside the inner cavity, and the opening is hermetically closed by the temperature sensor such that air flow via the opening is prevented.

6. The system of claim 5, wherein:

the electrical apparatus further comprises at least one electrically powered data outlet configured for being connected to at least one external device, the data outlet being located in the holding room; and the data generating end of the temperature sensor is connected to the at least one data outlet and configured for transmitting the temperature data to the data outlet.

7. The system of claim 1, further comprising:

a pressure sensor configured to measure pressure in the inner cavity and located in the holding room; and a pressure display configured to display data indicative of the pressure measured by the pressure sensor and located in the holding room.

8. The system of claim 7, wherein:

the electrical apparatus further comprises at least one electrically powered data outlet configured for being connected to at least one external device, the data outlet being located in the holding room;

the pressure sensor is configured to generate pressure data indicative of the pressure measured by the pressure sensor;

the pressure sensor is connected to the at least on data outlet and is configured to transmit to the data outlet the pressure data.

9. The system of claim 1, wherein the inner cavity is configured according to the first safety standards to hold the hazardous material in liquid form and according to second safety standards to hold the vapor of the hazardous material at an ignitable concentration, when the front door and the back door are closed.

10. A vacuum oven system configured to dry a first material treated with at least one hazardous material, the vacuum having a rear portion and a front portion, the rear portion extending horizontally from a rear face of the vacuum oven to an intermediate location and the front portion extending horizontally from the intermediate position to a front face of the vacuum oven, the vacuum oven comprising:

an inner cavity configured for holding the first material treated with the at least one hazardous material;

an electrically powered heating element configured to heat the inner cavity, the heating element being joined to an outer surface of the housing and being located in the front portion of the vacuum oven;

piping in fluid communication with the inner cavity and configured to lead from the inner cavity to an electrically powered vacuum pump configured to lower pressure within the inner cavity;

a front door covering the front face vacuum oven;

a back door covering the rear face of the vacuum oven;

an electrical apparatus located in the front portion, the electrical apparatus being electrically connected to the heating element and configured to be electrically connected to the vacuum pump, the electrical apparatus comprising an electrically powered control panel configured to receive from a user an input to operate the heating element and the vacuum pump and configured to operate the heating element and the vacuum pump according to the input;

wherein:

the control panel is configured to control an operation of the vacuum pump and comprises a first valve configured to controlling air flow through the piping from the inner cavity to the vacuum pump and a second valve configure to control air flow from an external environment into the inner cavity;

the vacuum oven is configured to be embedded in a wall separating a manufacturing room configured according to safety standards to hold the at least one hazardous material and a holding room, wherein the front portion is configured to fully extend into the holding room and the rear portion at least partially extends into the manufacturing room;

the vacuum oven is configured to receive the first material treated with the at least one hazardous material from the manufacturing room via the back door;

when both the front door and the back door are closed, the heating element is configured to be controlled by the user via the control panel to raise a temperature of the inner cavity, the vacuum pump is configured to be controlled by the user via the control panel to lower the pressure within the inner cavity, the first valve is configured to be opened to allow air flow from the inner cavity to the vacuum pump, and the second valve is closed to prevent air flow from the external environment to the inner cavity, such that to the pressure within the inner cavity is lower than a vapor pressure of the hazardous material at the temperature of the inner cavity, thereby vaporizing the hazardous material, the vacuum pump being further configured to lead a vapor of the hazardous material out of the inner cavity, thereby removing at least some of the hazardous material from the first material and from the inner cavity and reducing a concentration of the vapor of the hazardous material below a predetermined ignitable concentration;

the front door is configured to be opened from the holding room for removing the first material from the inner cavity following removal of the at least one hazardous material from the first material; and no electrical components of the vacuum oven extend to the rear portion.

11. The vacuum oven of claim 10, comprising an interlock configured for preventing an opening of the front door and the back door during the operation of the heating element and of the vacuum pump.

12. The vacuum oven of claim 10, comprising:

a gas sensor configured for measuring a quantity of the vapor of the hazardous material in the air flowing through the piping from the inner cavity and to generate gas data indicative of the measured quantity;

an interlock configured to lock the front door;

a control unit configured to receive the gas data and connected to the interlock, the control unit being configured to release the interlock, thereby unlocking the front door, when the measured quantity is below a predetermined threshold level.

13. The vacuum oven of claim 10, wherein the electrical apparatus further comprises at least one electrically powered data outlet configured for being connected to at least one external device, the data outlet being located in the holding room.

14. The vacuum oven of claim 10, further comprising:

a temperature sensor configured to measure the temperature in the inner cavity and to generate temperature data indicative of the temperature in the inner cavity, the temperature sensor having a sensing end located within the inner cavity in the front portion and a data generating end located outside the inner cavity;

a temperature display located on the control panel and configured to receive the temperature data and to display an image indicative of the temperature measured by the temperature sensor;

wiring leading from the data generating end of the temperature sensor to the temperature display, the wiring being located outside the inner cavity;

wherein the temperature sensor is joined to the housing of the inner cavity via an opening on the housing, such that the sensing end extends inside the inner cavity and the data generating end is located outside the inner cavity, and the opening is hermetically closed by the temperature sensor such that air flow via the opening is prevented.

15. The vacuum oven of claim 14, wherein:

the electrical apparatus further comprises at least one electrically powered data outlet configured for being connected to at least one external device, the data outlet being located in the front portion; and the data generating end of the temperature sensor is connected to the at least one data outlet and configured for transmitting the temperature data to the data outlet.

16. The vacuum oven of claim 10, further comprising:

a pressure sensor configured to measure pressure in the inner cavity and located in the front portion; and a pressure display configured to display data indicative of the pressure measured by the pressure sensor and located on the control panel.

17. The vacuum oven of claim 16, wherein:

the electrical apparatus further comprises at least one electrically powered data outlet configured for being connected to at least one external device, the data outlet being located in the front portion;

the pressure sensor is configured to generate pressure data indicative of the pressure measured by the pressure sensor;

the pressure sensor is connected to the at least on data outlet and is configured to transmit to the data outlet the pressure data.

18. The system of claim 10, wherein the inner cavity is configured according to first safety standards to hold the hazardous material in liquid form and according to second safety standards to hold the vapor of the hazardous material at an ignitable concentration, when the front door and the back door are closed.

* * * * *